US012410942B2

(12) United States Patent
Takegami et al.

(10) Patent No.: US 12,410,942 B2
(45) Date of Patent: Sep. 9, 2025

(54) HEAT SOURCE UNIT AND REFRIGERATION APPARATUS

(71) Applicant: DAIKIN INDUSTRIES, LTD., Osaka (JP)

(72) Inventors: Masaaki Takegami, Osaka (JP); Akitoshi Ueno, Osaka (JP); Shuichi Taguchi, Osaka (JP); Takuya Horita, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 273 days.

(21) Appl. No.: 17/696,211

(22) Filed: Mar. 16, 2022

(65) Prior Publication Data

US 2022/0205680 A1 Jun. 30, 2022

Related U.S. Application Data

(63) Continuation of application No. PCT/JP2020/025237, filed on Jun. 26, 2020.

(30) Foreign Application Priority Data

Sep. 30, 2019 (JP) ..... 2019-179465

(51) Int. Cl.
*F24F 13/30* (2006.01)
*F25B 6/02* (2006.01)
(Continued)

(52) U.S. Cl.
CPC ..... *F24F 13/30* (2013.01); *F25B 6/02* (2013.01); *F25B 7/00* (2013.01); *F25B 13/00* (2013.01); *F25B 43/00* (2013.01); *F25B 49/02* (2013.01)

(58) Field of Classification Search
CPC ..... F25B 2313/0233; F25B 2313/0231; F25B 2309/061; F25B 2400/0401; F25B 49/022; F25B 41/26; F25B 29/003; F25B 9/008
See application file for complete search history.

(56) References Cited

U.S. PATENT DOCUMENTS

2008/0276635 A1* 11/2008 Terasaki ..... F25B 41/385 62/159
2013/0036757 A1* 2/2013 Okaichi ..... F25B 1/10 62/228.3
(Continued)

FOREIGN PATENT DOCUMENTS

EP 1 988 345 A1 11/2008
EP 3 425 308 A1 1/2019
(Continued)

OTHER PUBLICATIONS

Extended European Search Report for European Application No. 20872367.6, dated Sep. 14, 2022.
(Continued)

*Primary Examiner* — Devon Lane
(74) *Attorney, Agent, or Firm* — Birch, Stewart, Kolasch & Birch, LLP

(57) ABSTRACT

A refrigeration apparatus includes a gas-liquid separator on a downstream side of a radiator, and a refrigerant circuit in which a high pressure of a refrigeration cycle is equal to or higher than a critical pressure. The refrigeration apparatus includes a gas passage that communicates with the gas-liquid separator and at least one of a plurality of heat exchangers provided in the refrigerant circuit, and an opening and closing device that opens and closes the gas passage. There is provided a controller that opens the opening and closing device when a pressure in the gas-liquid separator is equal to or higher than a predetermined value in a state
(Continued)

where a compression unit of the refrigerant circuit is stopped to suppress occurrence of pressure abnormality inside the gas-liquid separator in a state where a compressor is stopped.

15 Claims, 11 Drawing Sheets

(51) Int. Cl.

| | |
|---|---|
| ***F25B 7/00*** | (2006.01) |
| ***F25B 13/00*** | (2006.01) |
| ***F25B 43/00*** | (2006.01) |
| *F25B 49/02* | (2006.01) |

(56) References Cited

U.S. PATENT DOCUMENTS

| | | | | |
|---|---|---|---|---|
| 2014/0238066 | A1* | 8/2014 | Perevozchikov | F25B 49/02 62/324.6 |
| 2019/0063792 | A1* | 2/2019 | Kim | F24F 11/67 |

FOREIGN PATENT DOCUMENTS

| | | | | | |
|---|---|---|---|---|---|
| JP | 2003240365 | A | * | 8/2003 | |
| JP | 2015148407 | A | * | 8/2015 | F25B 1/005 |
| JP | 2018-9767 | A | | 1/2018 | |
| WO | WO 2007/083794 | A1 | | 7/2007 | |
| WO | WO 2017/138419 | A1 | | 8/2017 | |

OTHER PUBLICATIONS

English translation of the International Preliminary Report on Patentability and Written Opinion of the International Searching Authority for International Application No. PCT/JP2020/025237, dated Apr. 14, 2022.

International Search Report (PCT/ISA/210) issued in PCT/JP2020/025237, dated Sep. 15, 2020.

* cited by examiner

HEATING AND REFRIGERATION-FACILITY HEAT RECOVERY OPERATION

HEAT SOURCE UNIT AND REFRIGERATION APPARATUS

CROSS REFERENCE TO RELATED APPLICATIONS

This application is a Continuation of PCT International Application No. PCT/JP2020/025237, filed on Jun. 26, 2020, which claims priority under 35 U.S.C. 119(a) to Patent Application No. 2019-179465, filed in Japan on Sep. 30, 2019, all of which are hereby expressly incorporated by reference into the present application.

TECHNICAL FIELD

The present disclosure relates to a heat source unit and a refrigeration apparatus.

BACKGROUND ART

Conventionally, carbon dioxide is used as a refrigerant in a refrigerant circuit of a refrigeration apparatus. In a refrigerant circuit using carbon dioxide as a refrigerant, a supercritical refrigeration cycle is performed in which a high pressure of the refrigerant becomes equal to or higher than a critical pressure.

As described above, there is a refrigeration apparatus including a refrigerant circuit that performs a supercritical refrigeration cycle, in which a gas-liquid separator is provided on a downstream side of a radiator (see, for example, Patent Literature 1).

CITATION LIST

Patent Literature

Patent Literature 1: WO 2017/138419 A

SUMMARY

A first aspect of the present disclosure assumes that a heat source unit includes a refrigerant circuit (6) connected to a utilization side apparatus and configured to perform a refrigeration cycle in which a high pressure is equal to or higher than a critical pressure of a refrigerant.

This heat source unit includes a compression unit (20), a gas-liquid separator (15), a gas passage (70) configured to communicate with a gas outlet (15*a*) of the gas-liquid separator (15) and at least one of a plurality of heat exchangers (13, 17, 54, 64) provided in the refrigerant circuit (6), an opening and closing device (71) configured to open and close the gas passage (70), and a controller (100) configured to close the opening and closing device (71) when a pressure in the gas-liquid separator (15) is equal to or less than a predetermined value in a state where the compression unit (20) is stopped, and open the opening and closing device (71) when the pressure in the gas-liquid separator (15) is higher than the predetermined value.

DESCRIPTION OF EMBODIMENTS

Hereinafter, an outdoor unit (heat source unit) and a refrigeration apparatus according to embodiments will be described with reference to the drawings. Note that the following embodiments are essentially preferred examples, and are not intended to limit the scope of the present invention, matters to which the present invention is applicable, or the usage of the present invention.

First Embodiment

<Overall Configuration>

A refrigeration apparatus (1) according to a first embodiment simultaneously performs cooling of a cooling target and air conditioning in a room. The cooling target herein includes refrigeration facilities such as a refrigerator, a freezer, and a showcase. Hereinafter, the refrigeration facilities for such cooling target are referred to as a refrigeration facility for short.

Figure 1:
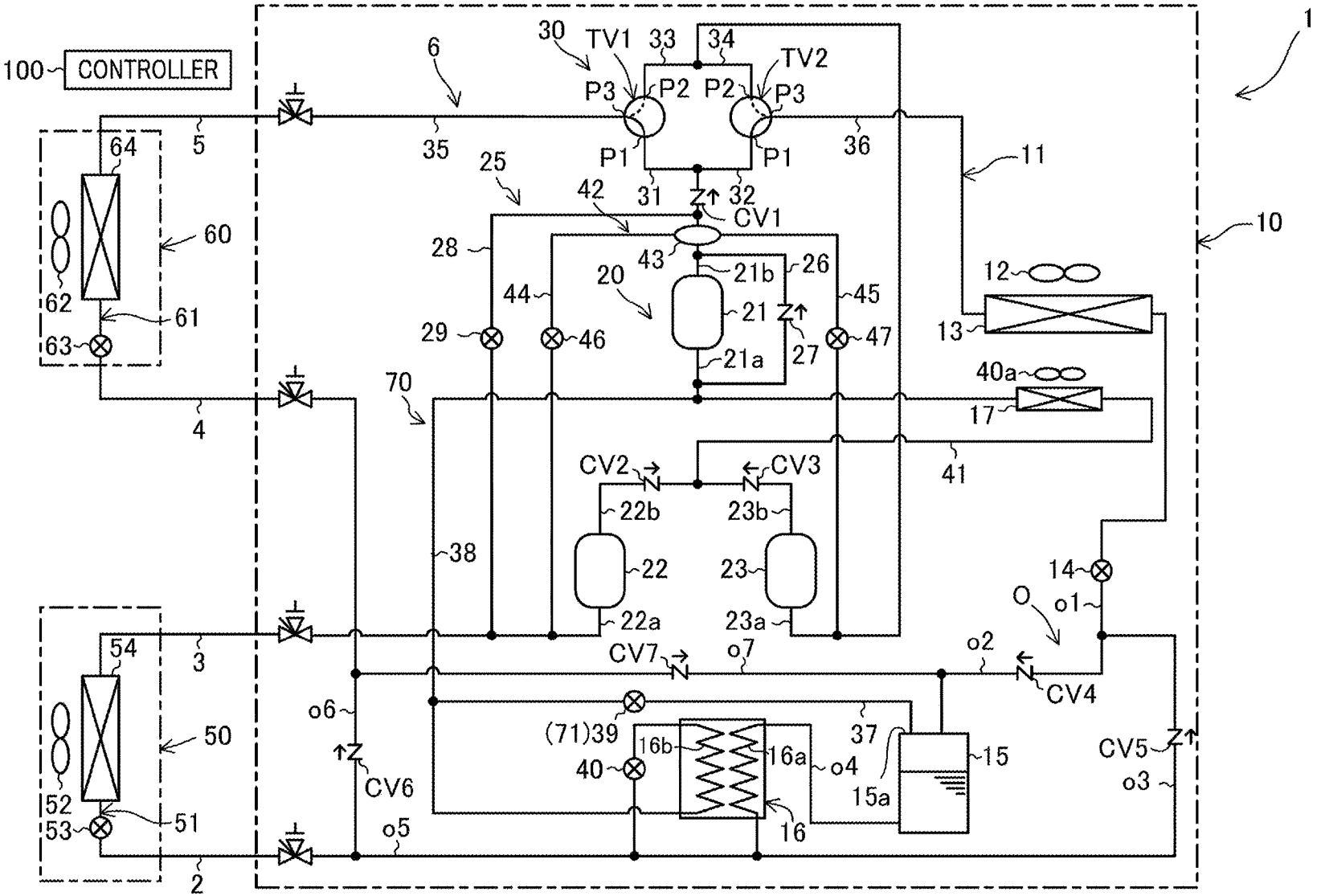
FIG. 1 is a piping system diagram of a refrigeration apparatus according to a first embodiment.

As illustrated in FIG. 1, the refrigeration apparatus (1) includes an outdoor unit (10) installed outdoors, a refrigeration-facility unit (50) that cools interior air of a storage such as a refrigerator, an indoor unit (60) for air conditioning of a room, and a controller (100). The numbers of the refrigeration-facility units (50) and the indoor units (60) are each not limited to one, but may be two or more, for example. In the present embodiment, these units (10, 50, 60) are connected to one another by four connection pipes (2, 3, 4, 5) to constitute a refrigerant circuit (6).

The four connection pipes (2, 3, 4, 5) include a first liquid connection pipe (2), a first gas connection pipe (3), a second liquid connection pipe (4), and a second gas connection pipe (5). The first liquid connection pipe (2) and the first gas connection pipe (3) correspond to the refrigeration-facility unit (50). The second liquid connection pipe (4) and the second gas connection pipe (5) correspond to the indoor unit (60).

The refrigerant circuit (6) executes a refrigeration cycle by circulation of a refrigerant. The refrigerant in the refrigerant circuit (6) of the present embodiment is carbon dioxide. The refrigerant circuit (6) performs the refrigeration cycle in which a high pressure of the refrigerant is equal to or higher than a critical pressure.

<Outdoor Unit>

The outdoor unit (10) is a heat source unit installed outdoors. The outdoor unit (10) includes an outdoor fan (12) and an outdoor circuit (11). The outdoor circuit (11) includes a compression unit (20), a switching unit (30), an outdoor heat exchanger (13), an outdoor expansion valve (14), a gas-liquid separator (15), a cooling heat exchanger (16), and an intermediate cooler (17).

<Compression Unit>

The compression unit (20) compresses the refrigerant. The compression unit (20) includes a first compressor (21), a second compressor (22), and a third compressor (23). The compression unit (20) is configured as a two-stage compression type. The second compressor (22) and the third compressor (23) constitute a low-stage side compressor (low-stage side compression element). The second compressor (22) and the third compressor (23) are connected in parallel to each other. The first compressor (21) constitutes a high-stage side compressor (high-stage side compression element). The first compressor (21) and the second compressor (22) are connected in series to each other. The first compressor (21) and the third compressor (23) are connected in series to each other. The first compressor (21), the second compressor (22), and the third compressor (23) are rotary compressors whose compression mechanisms are driven by motors. The first compressor (21), the second compressor (22), and the third compressor (23) are configured as variable displacement compressors capable of adjusting an operating frequency or a rotational speed. In the compression unit (20), the refrigerant compressed by the second compressor (22) and the third compressor (23) is further compressed by the first compressor (21).

A first suction pipe (21*a*) and a first discharge pipe (21*b*) are connected to the first compressor (21). A second suction pipe (22*a*) and a second discharge pipe (22*b*) are connected to the second compressor (22). A third suction pipe (23*a*) and a third discharge pipe (23*b*) are connected to the third compressor (23).

The second suction pipe (22*a*) communicates with the refrigeration-facility unit (50). The second compressor (22) is a refrigeration-facility side compressor corresponding to the refrigeration-facility unit (50). The third suction pipe (23*a*) communicates with the indoor unit (60). The third compressor (23) is an indoor-side compressor corresponding to the indoor unit (60).

<Switching Unit>

The switching unit (switching device) (30) switches a flow path of the refrigerant. The switching unit (30) includes a first pipe (31), a second pipe (32), a third pipe (33), a fourth pipe (34), a first three-way valve (TV1), and a second three-way valve (TV2). An inflow end of the first pipe (31) and an inflow end of the second pipe (32) are connected to the first discharge pipe (21*b*). The first pipe (31) and the second pipe (32) are pipes on which a discharge pressure of the compression unit (20) acts. An outflow end of the third pipe (33) and an outflow end of the fourth pipe (34) are connected to the third suction pipe (23*a*) of the third compressor (23). The third pipe (33) and the fourth pipe (34) are pipes on which a suction pressure of the compression unit (20) acts.

The first three-way valve (TV1) has a first port (P1), a second port (P2), and a third port (P3). The first port (P1) of the first three-way valve (TV1) is connected to an outflow end of the first pipe (31) as a high-pressure flow path. The second port (P2) of the first three-way valve (TV1) is connected to an inflow end of the third pipe (33) as a low-pressure flow path. The third port (P3) of the first three-way valve (TV1) is connected to an indoor gas side flow path (35).

The second three-way valve (TV2) has a first port (P1), a second port (P2), and a third port (P3). The first port (P1) of the second three-way valve (TV2) is connected to an outflow end of the second pipe (32) as a high-pressure flow path. The second port (P2) of the second three-way valve (TV2) is connected to an inflow end of the fourth pipe (34) as a low-pressure flow path. The third port (P3) of the second three-way valve (TV2) is connected to an outdoor gas side flow path (36).

The first three-way valve (TV1) and the second three-way valve (TV2) are electric three-way valves. The three-way valves (TV1, TV2) switch between a first communication state (state shown by a solid line in FIG. 1) and a second communication state (state shown by a broken line in FIG. 1). In each three-way valve (TV1, TV2) in the first communication state, the first port (Pt) and the third port (P3) communicate with each other, and the second port (P2) is closed. In each three-way valve (TV1, TV2) in the second communication state, the second port (P2) and the third port (P3) communicate with each other, and the first port (P1) is closed.

<Outdoor Heat Exchanger>

The outdoor heat exchanger (13) constitutes a heat source heat exchanger. The outdoor heat exchanger (13) is a fin-and-tube air heat exchanger. The outdoor fan (12) is disposed near the outdoor heat exchanger (13). The outdoor fan (12) conveys outdoor air. The outdoor heat exchanger exchanges heat between the refrigerant flowing in the outdoor heat exchanger and the outdoor air conveyed by the outdoor fan (12).

An outdoor gas side flow path (36) is connected to a gas end of the outdoor heat exchanger (13). An outdoor flow path (O) is connected to a liquid end of the outdoor heat exchanger (13).

The outdoor heat exchanger (13) is a heat exchanger that serves as the radiator during cooling operation and serves as the evaporator during heating operation.

<Outdoor Flow Path>

The outdoor flow path (O) includes an outdoor first pipe (o1), an outdoor second pipe (o2), an outdoor third pipe (o3), an outdoor fourth pipe (o4), an outdoor fifth pipe (o5), an outdoor sixth pipe (o6), and an outdoor seventh pipe (o7). One end of the outdoor first pipe (o1) is connected to the liquid end of the outdoor heat exchanger (13). One end of the outdoor second pipe (o2) and one end of the outdoor third pipe (o3) are connected to the other end of the outdoor first pipe (o1). The other end of the outdoor second pipe (o2) is connected to a top of the gas-liquid separator (15). One end of the outdoor fourth pipe (o4) is connected to a bottom of the gas-liquid separator (15). One end of the outdoor fifth pipe (o5) and one end of the outdoor third pipe (o3) are connected to the other end of the outdoor fourth pipe (o4). The other end of the outdoor fifth pipe (o5) is connected to the first liquid connection pipe (2). One end of the outdoor sixth pipe (o6) is connected to a midway of the outdoor fifth pipe (o5). The other end of the outdoor sixth pipe (o6) is connected to the second liquid connection pipe (4). One end of the outdoor seventh pipe (o7) is connected to a midway of the outdoor sixth pipe (o6). One end of the outdoor seventh pipe (o7) is connected to a midway of the outdoor second pipe (o2).

<Outdoor Expansion Valve>

The outdoor expansion valve (14) is connected to the outdoor first pipe (o1). The outdoor expansion valve (14) is a decompression mechanism that decompresses the refrigerant. The outdoor expansion valve (14) is a heat source expansion valve. The outdoor expansion valve (14) is configured as an electronic expansion valve having a variable opening degree.

<Gas-Liquid Separator>

The gas-liquid separator (15) of the present embodiment constitutes a container that stores the refrigerant, and also has a function of a liquid receiver. The gas-liquid separator (15) separates the refrigerant into a gas refrigerant and a liquid refrigerant. The other end of the outdoor second pipe (o2) and one end of the gas vent pipe (37) are connected to the top of the gas-liquid separator (15). The other end of the gas vent pipe (37) is connected to a midway of an injection passage (first gas passage) (38). A gas vent valve (first opening and closing device) (39) is connected to the gas vent pipe (37). The gas vent valve (39) is configured as an electronic expansion valve having a variable opening degree. The gas vent valve (39) may be an openable electromagnetic valve.

<Cooling Heat Exchanger>

The cooling heat exchanger (16) cools the refrigerant (mainly liquid refrigerant) separated by the gas-liquid separator (15). The cooling heat exchanger (16) includes a first refrigerant flow path (16*a*) and a second refrigerant flow path (16*b*). The first refrigerant flow path (16*a*) is connected to a midway of the outdoor fourth pipe (o4). The second refrigerant flow path (16*b*) is connected to a midway of the injection passage (38).

One end of the injection passage (38) is connected to a midway of the outdoor fourth pipe (o4) (on a downstream side of the first refrigerant flow path (16*a*)). The other end of the injection passage (38) is connected to the first suction pipe (21*a*) of the first compressor (21). In other words, the other end of the injection passage (38) is connected to a middle pressure part of the compression unit (20). The injection passage (38) is provided with a first decompression valve (40) on an upstream side of the second refrigerant flow path (16*b*). The first decompression valve (40) is configured as an expansion valve having a variable opening degree.

In the cooling heat exchanger (16), the refrigerant flowing through the first refrigerant flow path (16*a*) and the refrigerant flowing through the second refrigerant flow path (16*b*) exchange heat with each other. The refrigerant decompressed by the first decompression valve (40) flows through the second refrigerant flow path (16*b*). The cooling heat exchanger (16) cools the refrigerant flowing through the first refrigerant flow path (16*a*).

<Intermediate Cooler>

The intermediate cooler (17) is connected to an intermediate flow path (41). One end of the intermediate flow path (41) is connected to the second discharge pipe (22*b*) of the second compressor (22) and the third discharge pipe (23*b*) of the third compressor (23). The other end of the intermediate flow path (41) is connected to the first suction pipe (21*a*) of the first compressor (21). In other words, the other end of the intermediate flow path (41) is connected to the middle pressure part of the compression unit (20).

The intermediate cooler (17) is a fin-and-tube air heat exchanger. A cooling fan (17*a*) is disposed near the intermediate cooler (17). The intermediate cooler (17) exchanges heat between the refrigerant flowing in the intermediate cooler and the outdoor air conveyed by the cooling fan (17*a*).

<Oil Separation Circuit>

The outdoor circuit (11) includes an oil separation circuit (42). The oil separation circuit (42) includes an oil separator (43), a first oil return pipe (44), and a second oil return pipe (45). The oil separator (43) is connected to the first discharge pipe (21*b*) of the first compressor (21). The oil separator (43) separates oil from the refrigerant discharged from the compression unit (20). Inflow ends of the first oil return pipe (44) and the second oil return pipe (45) are connected to the oil separator (43). An outflow end of the first oil return pipe (44) is connected to the second suction pipe (22*a*) of the second compressor (22). An outflow end of the second oil return pipe (45) is connected to the third suction pipe (23*a*) of the third compressor (23). A first oil amount regulating valve (46) is connected to the first oil return pipe (44). A second oil amount regulating valve (47) is connected to the second oil return pipe (45).

The oil separated by the oil separator (43) is returned to the second compressor (22) via the first oil return pipe (44). The oil separated by the oil separator (43) is returned to the third compressor (23) via the second oil return pipe (45). The oil separated by the oil separator (43) may be directly returned to an oil reservoir in a casing of the second compressor (22). The oil separated by the oil separator (43) may be directly returned to an oil reservoir in a casing of the third compressor (23).

<Bypass Passage>

A first bypass passage (26) that bypasses the first compressor (21) is connected to the first suction pipe (21*a*) and the second suction pipe (21*b*). A check valve (27) that allows a flow of the refrigerant from the first suction pipe (21*a*) to the second suction pipe (21*b*) and prohibits a flow of the refrigerant in a reverse direction is connected to the first bypass passage (26). A second bypass passage (28) is connected to the discharge side flow path (21*b*) of the first compressor (21) and the second suction side flow path (22*a*) of the second compressor (22). A bypass valve (second opening and closing device) (29) is connected to a second bypass passage (28). The bypass valve (29) includes an electronic expansion valve that adjusts a flow rate of the refrigerant in the second bypass passage (28).

<Gas Vent Structure of Gas-Liquid Separator>

The present embodiment includes a gas passage (70) and an opening and closing device (71). The gas passage (70) and the opening and closing device (71) are configured to release the gas refrigerant in the gas-liquid separator (15) to at least one of the plurality of heat exchangers (13, 17, 54, 64). This configuration suppresses an excessive increase in the pressure inside the gas-liquid separator (15).

The gas passage (70) has the injection passage (38) communicating with a gas outlet (15*a*) of the gas-liquid separator (15) and an intermediate heat exchanger (17) as the first gas passage for venting the gas refrigerant in the gas-liquid separator (15). The gas vent valve (39) provided in the injection passage (38) functions as the first opening and closing device that opens and closes the first gas passage. The gas-liquid separator (15) communicates with the intermediate heat exchanger (17) via the injection passage (38) and the intermediate flow path (41).

When the pressure in the gas-liquid separator (15) is higher than a predetermined value, the gas passage (70) includes a second gas passage (25) communicating with the heat exchanger having functioned as the evaporator before the compression unit (20) is stopped. The second gas passage (25) includes the first bypass passage (26) that bypasses the first compressor (21) and communicates with the first suction pipe (21*a*) and the second discharge pipe (21*b*) of the first compressor (21), and includes the second bypass passage (28) that communicates with the first discharge pipe (21*b*) of the first compressor (21) and the second suction pipe (21*a*) of the second compressor (22, 23).

As described above, the refrigerant circuit (6) includes the first three-way valve (TV1) and the second three-way valve (TV2) as the switching unit (switching device) (30) that switches a circulation direction of the refrigerant in the refrigerant circuit (6). The switching unit (30) is switchable between a first state, a second state, and a third state. In the first state, the first three-way valve (TV1) and the second three-way valve (TV2) are switched such that the indoor heat exchanger (64) to be described later communicates with the third suction pipe (23*a*) of the compression unit (20), and the outdoor heat exchanger (13) communicates with the first discharge pipe (21*b*) of the compression unit (20). In the second state, the first three-way valve (TV1) and the second three-way valve (TV2) are switched such that the indoor heat exchanger (64) communicates with the first discharge pipe (21*b*) of the compression unit (20), and the outdoor heat exchanger (13) communicates with the third suction pipe (23*a*) of the compression unit (20). In the third state, the first three-way valve (TV1) and the second three-way valve (TV2) are switched such that the indoor heat exchanger (64) and the outdoor heat exchanger (13) communicate with each other. In the third state, the gas passage (70) communicates with the indoor heat exchanger (64) and the outdoor heat exchanger (13).

In the above configuration, when the indoor heat exchanger (64) is the evaporator before the compression unit (20) is stopped, the gas-liquid separator (15) communicates with the indoor heat exchanger (64) via the injection passage (38), the first bypass passage (26), the indoor gas side flow path (35), and the second gas connection pipe (5). As a result, the gas refrigerant in the gas-liquid separator (15) flows into the indoor heat exchanger (64) serving as the evaporator before the compression unit (20) is stopped. When the outdoor heat exchanger (13) serves as the evaporator before the compression unit (20) is stopped, the gas-liquid separator (15) communicates with the outdoor heat exchanger (13) via the injection passage (38), the first bypass passage (26), and the outdoor gas side flow path (36). As a result, the gas refrigerant in the gas-liquid separator (15) flows into the outdoor heat exchanger (13) serving as the evaporator before the compression unit (20) is stopped.

<Check Valve>

The outdoor circuit (11) includes a first check valve (CV1), a second check valve (CV2), a third check valve (CV3), a fourth check valve (CV4), a fifth check valve (CV5), a sixth check valve (CV6), and a seventh check valve (CV7). The first check valve (CV1) is connected to the first discharge pipe (21*b*). The second check valve (CV2) is connected to the second discharge pipe (22*b*). The third check valve (CV3) is connected to the third discharge pipe (23*b*). The fourth check valve (CV4) is connected to the outdoor second pipe (o2). The fifth check valve (CV5) is connected to the outdoor third pipe (3). The sixth check valve (CV6) is connected to the outdoor sixth pipe (o6). The seventh check valve (CV7) is connected to the outdoor seventh pipe (o7). Each of the check valves (CV1 to CV7) allows the refrigerant to flow in the direction indicated by an arrow in FIG. 1, and prohibits the flow of the refrigerant in an opposite direction to the arrow.

<Refrigeration-Facility Unit>

The refrigeration-facility unit (50) is, for example, a utilization unit (utilization side apparatus) installed in a refrigerating warehouse. The refrigeration-facility unit (50) includes an interior fan (52) and a refrigeration-facility circuit (51). The first liquid connection pipe (2) is connected to a liquid end of the refrigeration-facility circuit (51). The first gas connection pipe (3) is connected to a gas end of the refrigeration-facility circuit (51).

The refrigeration-facility circuit (51) includes, in order from a liquid end to a gas end, a refrigeration-facility expansion valve (53) and a refrigeration-facility heat exchanger (heat exchanger for refrigeration equipment) (54). The refrigeration-facility expansion valve (53) is a first utilization expansion valve. The refrigeration-facility expansion valve (53) is an electronic expansion valve having a variable opening degree.

The refrigeration-facility heat exchanger (54) is a first utilization heat exchanger. The refrigeration-facility heat exchanger (54) is a fin-and-tube air heat exchanger. The interior fan (52) is disposed near the refrigeration-facility heat exchanger (54). The interior fan (52) conveys interior air. The refrigeration-facility heat exchanger (54) exchanges heat between the refrigerant flowing in the refrigeration-facility heat exchanger and the interior air conveyed by the interior fan (52).

<Indoor Unit>

The indoor unit (60) is a utilization unit (utilization side apparatus) installed indoors. The indoor unit (60) includes an indoor fan (62) and an indoor circuit (61). The second liquid connection pipe (4) is connected to a liquid end of the indoor circuit (61). The second gas connection pipe (15) is connected to a gas end of the indoor circuit (61).

The indoor circuit (61) includes, in order from a liquid end to a gas end, an indoor expansion valve (63) and the indoor heat exchanger (air conditioning heat exchanger) ((A). The indoor expansion valve (63) is a second utilization expansion valve. The indoor expansion valve (63) is an electronic expansion valve having a variable opening degree.

The indoor heat exchanger (64) is a second utilization heat exchanger. The indoor heat exchanger (64) is a fin-and-tube air heat exchanger. The indoor fan (62) is disposed near the indoor heat exchanger (64). The indoor fan (62) conveys indoor air. The indoor heat exchanger (64) exchanges heat between the refrigerant flowing in the indoor heat exchanger and the indoor air conveyed by the indoor fan (62).

The indoor heat exchanger (64) is a heat exchanger that serves as the radiator during heating operation and serves as the evaporator during cooling operation.

<Sensor>

The refrigeration apparatus (1) includes various sensors (not shown). Examples of indices detected by these sensors include a temperature and a pressure of high-pressure refrigerant in the refrigerant circuit (6), a temperature and a pressure of refrigerant in the gas-liquid separator (15), a temperature and a pressure of low-pressure refrigerant, a temperature and a pressure of intermediate-pressure refrigerant, a temperature of refrigerant in the outdoor heat exchanger (13), a temperature of refrigerant in the refrigeration-facility heat exchanger (54), a temperature of refrigerant in the indoor heat exchanger (64), a degree of superheating of sucked refrigerant in the second compressor (22), a degree of superheating of sucked refrigerant in the third compressor (23), a temperature of the outdoor air, a temperature of the interior air, and a temperature of the indoor air.

<Controller>

The controller (100) serving as a controller includes a microcomputer mounted on a control board and a memory device (specifically, a semiconductor memory) that stores software for operating the microcomputer. The controller (100) controls each device of the refrigeration apparatus (1)

on the basis of an operation command and detection signals of the sensors. The operation of the refrigeration apparatus (1) is switched through control of each device by the controller (100). The controller (100) is connected to various sensors including a temperature sensor that detects the temperature of the high-pressure refrigerant in the refrigerant circuit (6) via a communication line. The controller (100) is connected to components of the refrigerant circuit (6) including the first compressor (21), the second compressor (22), the third compressor (23), and the like via the communication line.

The controller (100) closes the opening and closing device (71) when the pressure in the gas-liquid separator (15) is equal to or less than a predetermined value in a state where the compression unit (20) is stopped, and opens the opening and closing device (71) when the pressure in the gas-liquid separator (15) is higher than the predetermined value. When the pressure in the gas-liquid separator (15) is higher than the predetermined value while the compression unit (20) is stopped, the refrigerant in the gas-liquid separator (15) flows into the intermediate heat exchanger (17). When the refrigerant is carbon dioxide, the predetermined value is set to, for example, about 8 MPa. Details of the control will be described later with reference to a flowchart.

In a case where the refrigeration-facility heat exchanger (54) serves as the evaporator before the compression unit (20) is stopped, when the pressure in the gas-liquid separator (15) is still higher than a predetermined value though the gas refrigerant in the gas-liquid separator (15) is introduced into the intermediate heat exchanger (17), the controller (100) opens the bypass valve (29) as the second opening and closing device. Thus, the gas-liquid separator (15) communicates with the refrigeration-facility heat exchanger (54) via the injection passage (38), the first bypass passage (26), and the second bypass passage (28). As a result, the gas refrigerant in the gas-liquid separator (15) is introduced into the refrigeration-facility heat exchanger (54) having functioned as the evaporator before the compression unit (20) is stopped.

The controller (100) also performs control to switch the switching unit (30) to the third state and allow the gas passage (70) to communicate with the indoor heat exchanger (64) and the outdoor heat exchanger (13).

—Operation—

The operation of the refrigeration apparatus (1) will be described in detail. The operation of the refrigeration apparatus (1) includes refrigeration-facility operation, cooling operation, cooling and refrigeration-facility operation, heating operation, heating and refrigeration-facility operation, heating and refrigeration-facility heat recovery operation, heating and refrigeration-facility residual heat operation, and defrost operation.

During the refrigeration-facility operation, the refrigeration-facility unit (50) is operated and the indoor unit (60) is stopped. During the cooling operation, the refrigeration-facility unit (50) is stopped and the indoor unit (60) performs cooling. During the cooling and refrigeration-facility operation, the refrigeration-facility unit (50) is operated and the indoor unit (60) performs cooling. During the heating operation, the refrigeration-facility unit (50) is stopped and the indoor unit (60) performs heating. During each of the heating and refrigeration-facility operation, the heating and refrigeration-facility heat recovery operation, and the heating and refrigeration-facility residual heat operation, the refrigeration-facility unit (50) is operated and the indoor unit (60) performs heating. During the defrost operation, the refrigeration-facility unit (50) is operated to melt frost on the surface of the outdoor heat exchanger (13).

The heating and refrigeration-facility operation is executed under the condition that a required heating capacity of the indoor unit (60) is relatively high. The heating and refrigeration-facility residual heat operation is executed under the condition that the required heating capacity of the indoor unit (60) is relatively low. The heating and refrigeration-facility heat recovery operation is executed under the condition that the required heating capacity of the indoor unit (60) is the required heating capacity during the heating and refrigeration-facility operation (condition that the refrigeration-facility operation and the heating operation are balanced).

<Refrigeration-Facility Operation>

Figure 2:
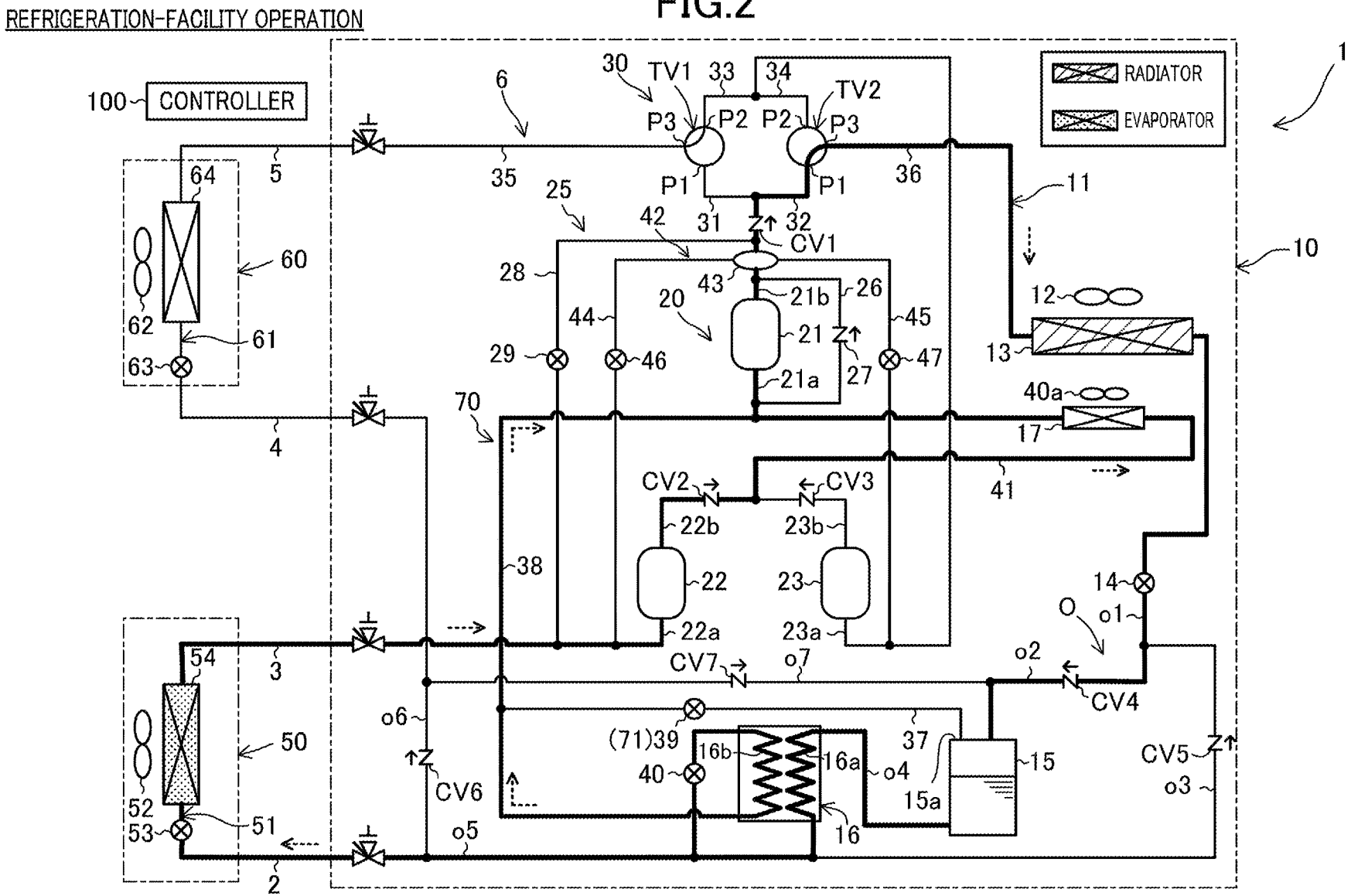
FIG. 2 is a diagram corresponding to FIG. 1, illustrating a flow of refrigerant in a refrigeration-facility operation.

During the cooling and refrigeration-facility operation illustrated in FIG. 2, the first three-way valve (TV1) is in the second communication state, and the second three-way valve (TV2) is in the first communication state. The outdoor expansion valve (14) is opened at a predetermined opening degree, the opening degree of the refrigeration-facility expansion valve (53) is adjusted through superheating control, the indoor expansion valve (63) is fully closed, and the opening degree of the first decompression valve (40) is appropriately adjusted. The outdoor fan (12) and the interior fan (52) are operated, and the indoor fan (62) is stopped. The first compressor (21) and the second compressor (22) are operated, and the third compressor (23) is stopped. In the refrigeration-facility operation, a refrigeration cycle is performed in which the refrigerant compressed in the compression unit (20) radiates heat in the outdoor heat exchanger (13) and evaporates in the refrigeration-facility heat exchanger (54).

As illustrated in FIG. 2, the refrigerant compressed in the second compressor (22) is cooled by the intermediate cooler (17) and then sucked into the first compressor (21). The refrigerant compressed in the first compressor (21) radiates heat in the outdoor heat exchanger (13), flows through the gas-liquid separator (15), and is cooled in the first refrigerant flow path (16*a*) of the cooling heat exchanger (16). The refrigerant in the second refrigerant flow path (16*b*) that has cooled the refrigerant in the first refrigerant flow path (16*a*) flows through the injection passage (38) and is sucked into the first compressor (21). The refrigerant cooled in the first refrigerant flow path (16*a*) of the cooling heat exchanger (16) is decompressed by the refrigeration-facility expansion valve (53) and then evaporates in the refrigeration-facility heat exchanger (54). As a result, the interior air is cooled. The refrigerant having evaporated in the cooling heat exchanger (16) is sucked into the second compressor (22) to be compressed again.

<Cooling Operation>

Figure 3:
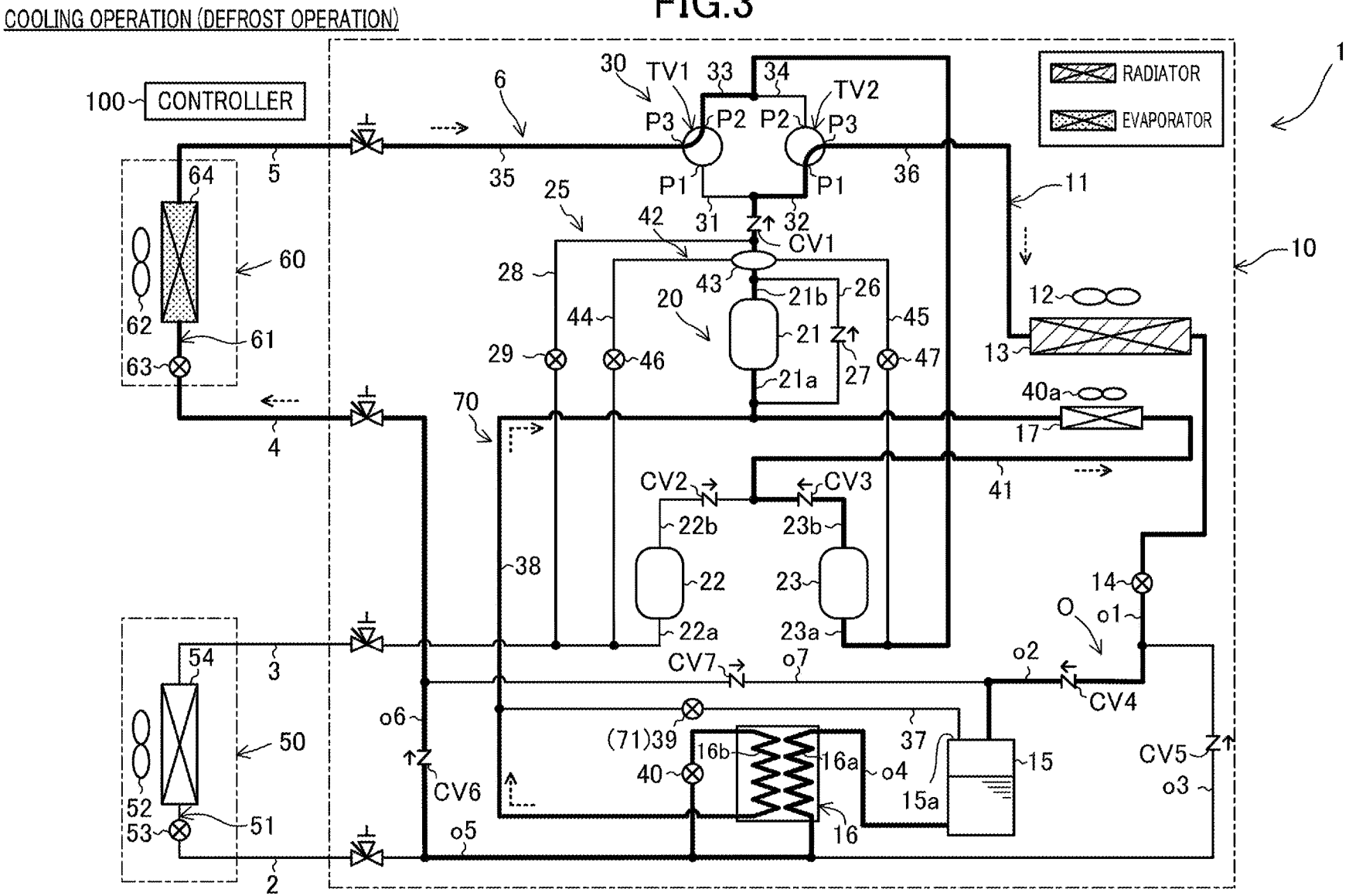
FIG. 3 is a diagram corresponding to FIG. 1, illustrating a flow of refrigerant in a cooling operation.

During the cooling operation illustrated in FIG. 3, the first three-way valve (TV1) is in the second communication state, and the second three-way valve (TV2) is in the first communication state. The outdoor expansion valve (14) is opened at a predetermined opening degree, the refrigeration-facility expansion valve (53) is fully closed, the opening degree of the indoor expansion valve (63) is adjusted through superheating control, and the opening degree of the first decompression valve (40) is appropriately adjusted. The outdoor fan (12) and the indoor fan (62) are operated, and the interior fan (52) is stopped. The first compressor (21) and the third compressor (23) are operated, and the second compressor (22) is stopped. In the cooling operation, a refrigeration cycle is performed in which the refrigerant compressed in the compression unit (20) radiates heat in the outdoor heat exchanger (13) and evaporates in the indoor heat exchanger (64).

As illustrated in FIG. 3, the refrigerant compressed in the third compressor (23) is cooled by the intermediate cooler (17) and then sucked into the first compressor (21). The refrigerant compressed in the first compressor (21) radiates heat in the outdoor heat exchanger (13), flows through the gas-liquid separator (15), and is cooled in the first refrigerant flow path (16*a*) of the cooling heat exchanger (16). The refrigerant in the second refrigerant flow path (16*b*) that has cooled the refrigerant in the first refrigerant flow path (16*a*) flows through the injection passage (38) and is sucked into the first compressor (21). The refrigerant cooled in the first refrigerant flow path (16*a*) of the cooling heat exchanger (16) is decompressed by the indoor expansion valve (63) and then evaporates in the indoor heat exchanger (64). As a result, the indoor air is cooled. The refrigerant having evaporated in the indoor heat exchanger (64) is sucked into the third compressor (23) to be compressed again.

<Cooling and Refrigeration-Facility Operation>

Figure 4:
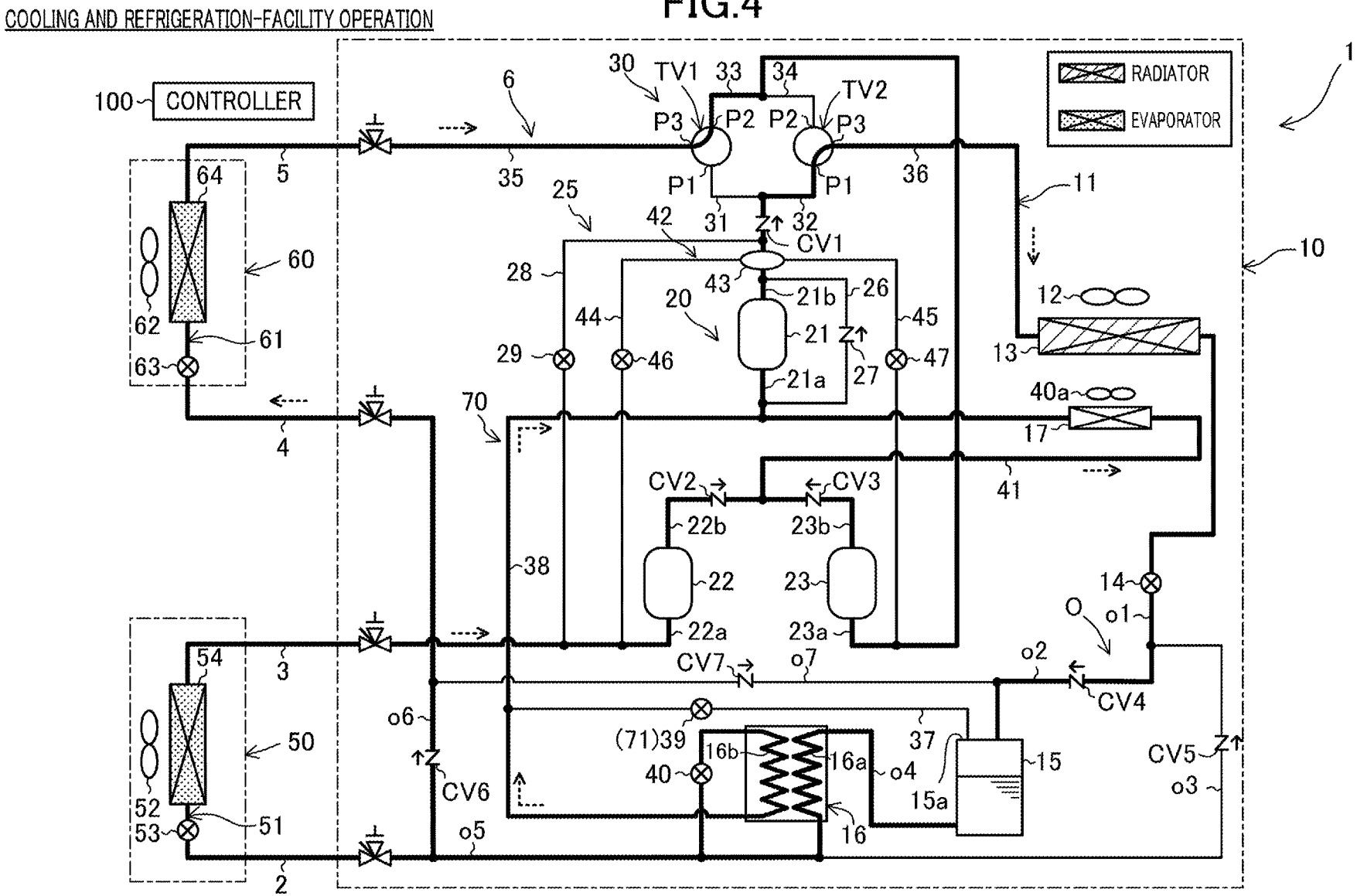
FIG. 4 is a diagram corresponding to FIG. 1, illustrating a flow of refrigerant in a cooling and refrigeration-facility operation.

During the cooling and refrigeration-facility operation illustrated in FIG. 4, the first three-way valve (TV1) is in the second communication state, and the second three-way valve (TV2) is in the first communication state. The outdoor expansion valve (14) is opened at a predetermined opening degree, the opening degrees of the refrigeration-facility expansion valve (53) and the indoor expansion valve (63) are adjusted through superheating control, and the opening degree of the first decompression valve (40) is appropriately adjusted. The outdoor fan (12), the interior fan (52), and the indoor fan (62) are operated. The first compressor (21), the second compressor (22), and the third compressor (23) are operated. During the cooling and refrigeration-facility operation, a refrigeration cycle is performed in which the refrigerant compressed in the compression unit (20) radiates heat in the outdoor heat exchanger (13) and evaporates in the refrigeration-facility heat exchanger (54) and the indoor heat exchanger (64).

As illustrated in FIG. 4, the refrigerant compressed in the second compressor (22) and the third compressor (23) is sucked into the first compressor (21). The refrigerant compressed in the first compressor (21) radiates heat in the outdoor heat exchanger (13), flows through the gas-liquid separator (15), and is cooled in the first refrigerant flow path (16*a*) of the cooling heat exchanger (16). The refrigerant in the second refrigerant flow path (16*b*) that has cooled the refrigerant in the first refrigerant flow path (16*a*) flows through the injection passage (38) and is sucked into the first compressor (21). The refrigerant cooled in first refrigerant flow path (16*a*) of cooling heat exchanger (16) is divided into refrigeration-facility unit (50) and indoor unit (60). The refrigerant decompressed by the refrigeration-facility expansion valve (53) evaporates in the refrigeration-facility heat exchanger (54). The refrigerant having evaporated in the refrigeration-facility heat exchanger (54) is sucked into the second compressor (22) to be compressed again. The refrigerant decompressed by the indoor expansion valve (63) evaporates in the indoor heat exchanger (64). The refrigerant having evaporated in the indoor heat exchanger (64) is sucked into the third compressor (23) to be compressed again.

<Heating Operation>

Figure 5:
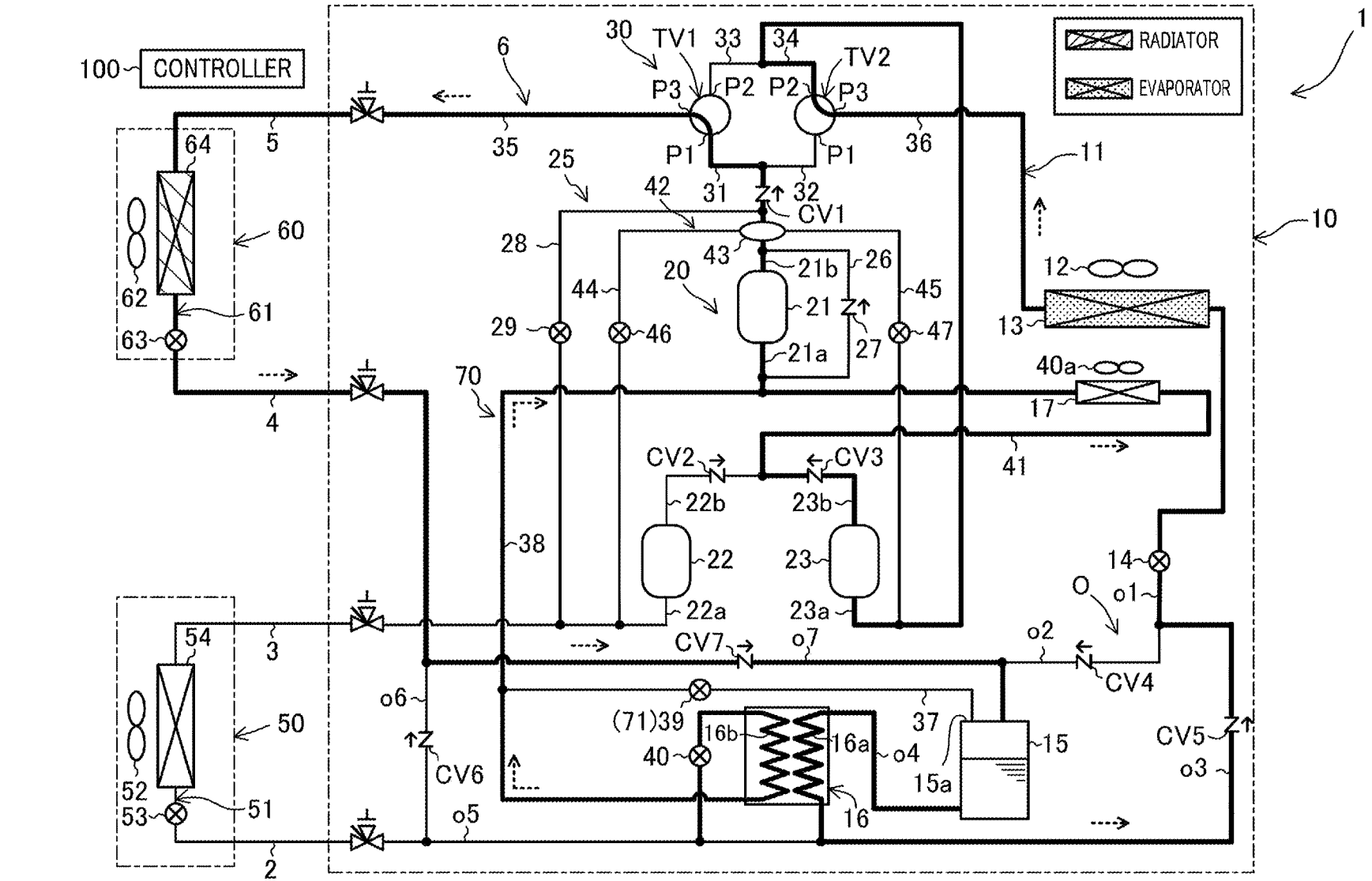
FIG. 5 is a diagram corresponding to FIG. 1, illustrating a flow of refrigerant in a heating operation.

During the heating operation illustrated in FIG. 5, the first three-way valve (TV1) is in the first communication state, and the second three-way valve (TV2) is in the second communication state. The indoor expansion valve (63) is opened at a predetermined opening degree, the refrigeration-facility expansion valve (53) is fully closed, the opening degree of the outdoor expansion valve (14) is adjusted through superheating control, and the opening degree of the first decompression valve (40) is appropriately adjusted. The outdoor fan (12) and the indoor fan (62) are operated, and the interior fan (52) is stopped. The first compressor (21) and the third compressor (23) are operated, and the second compressor (22) is stopped. In the heating operation, a refrigeration cycle is performed in which the refrigerant compressed in the compression unit (20) radiates heat in the indoor heat exchanger (64) and evaporates in the outdoor heat exchanger (13).

As illustrated in FIG. 5, the refrigerant compressed in the third compressor (23) is sucked into the first compressor (21). The refrigerant compressed in the first compressor (21) radiates heat in the indoor heat exchanger (64). As a result, the indoor air is heated. The refrigerant having radiated heat in the indoor heat exchanger (64) flows through the gas-liquid separator (15), and is cooled in the first refrigerant flow path (16*a*) of the cooling heat exchanger (16). The refrigerant in the second refrigerant flow path (16*b*) that has cooled the refrigerant in the first refrigerant flow path (16*a*) flows through the injection passage (38) and is sucked into the first compressor (21). The refrigerant cooled in the first refrigerant flow path (16*a*) of the cooling heat exchanger (16) is decompressed by the outdoor expansion valve (14) and then evaporates in the outdoor heat exchanger (13). The refrigerant having evaporated in the outdoor heat exchanger (13) is sucked into the third compressor (23) to be compressed again.

<Heating and Refrigeration-Facility Operation>

Figure 6:
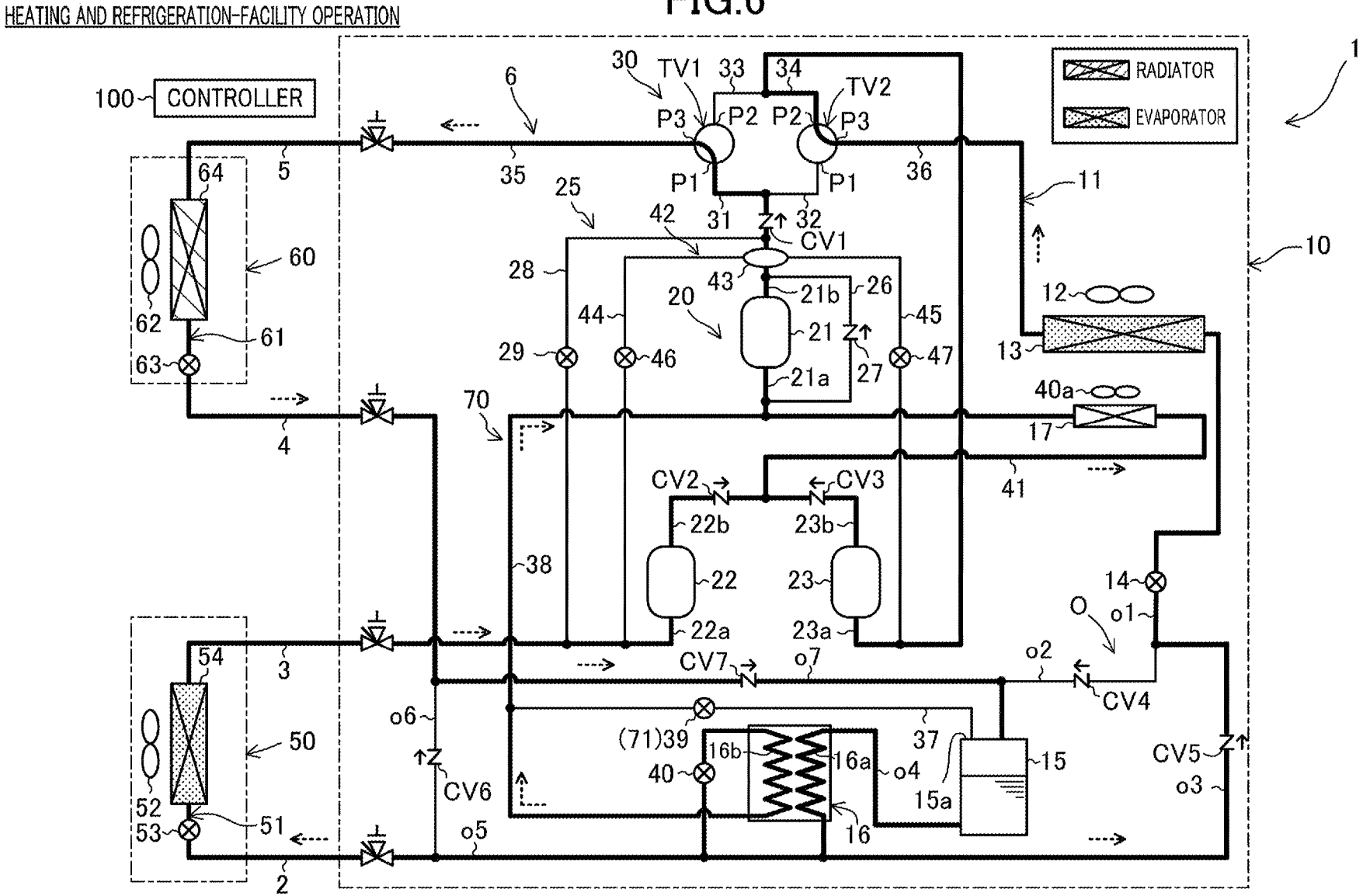
FIG. 6 is a diagram corresponding to FIG. 1, illustrating a flow of refrigerant in a heating and refrigeration-facility operation.

During the heating and refrigeration-facility operation illustrated in FIG. 6, the first three-way valve (TV1) is in the first communication state and the second three-way valve (TV2) is in the second communication state. The indoor expansion valve (63) is opened at a predetermined opening degree, the opening degrees of the refrigeration-facility expansion valve (53) and the outdoor expansion valve (14) are adjusted through superheating control, and the opening degree of the first decompression valve (40) is appropriately adjusted. The outdoor fan (12), the interior fan (52), and the indoor fan (62) are operated. The first compressor (21), the second compressor (22), and the third compressor (23) are operated. During the heating and refrigeration-facility operation, a refrigeration cycle is performed in which the refrigerant compressed in the compression unit (20) radiates heat in the indoor heat exchanger (64) and evaporates in the refrigeration-facility heat exchanger (54) and the outdoor heat exchanger (13).

As illustrated in FIG. 6, the refrigerant compressed in the second compressor (22) and the third compressor (23) is sucked into the first compressor (21). The refrigerant compressed in the first compressor (21) radiates heat in the indoor heat exchanger (64). As a result, the indoor air is heated. The refrigerant having radiated heat in the indoor heat exchanger (64) flows through the gas-liquid separator (15), and is cooled in the first refrigerant flow path (16*a*) of the cooling heat exchanger (16). The refrigerant in the second refrigerant flow path (16*b*) that has cooled the refrigerant in the first refrigerant flow path (16*a*) flows through the injection passage (38) and is sucked into the first compressor (21). Part of the refrigerant cooled in the first refrigerant flow path (16*a*) of the cooling heat exchanger (16) is decompressed by the outdoor expansion valve (14) and then evaporates in the outdoor heat exchanger (13). The refrigerant having evaporated in the outdoor heat exchanger (13) is sucked into the third compressor (23) to be compressed again.

The rest of the refrigerant cooled in the first refrigerant flow path (16*a*) of the cooling heat exchanger (16) is decompressed by the refrigeration-facility expansion valve (53) and then evaporates in the refrigeration-facility heat exchanger (54). As a result, the interior air is cooled. The refrigerant having evaporated in the refrigeration-facility heat exchanger (54) is sucked into the second compressor (22) to be compressed again.

<Heating and Refrigeration-Facility Heat Recovery Operation>

Figure 7:
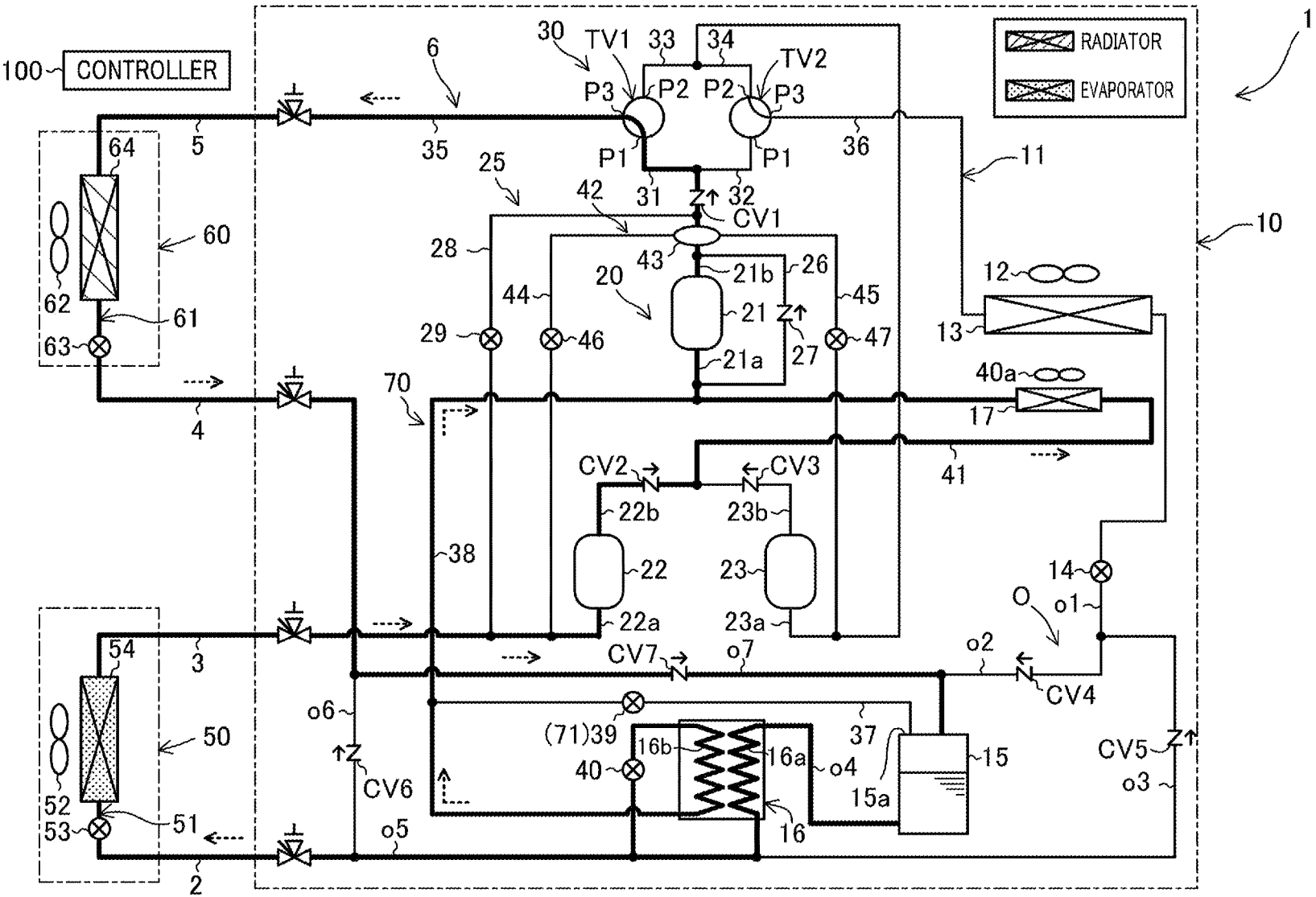
FIG. 7 is a diagram corresponding to FIG. 1, illustrating a flow of refrigerant in a heating and refrigeration-facility heat recovery operation.

During the heating and refrigeration-facility heat recovery operation illustrated in FIG. 7, the first three-way valve (TV1) is in the first communication state, and the second three-way valve (TV2) is in the second communication state. The indoor expansion valve (63) is opened at a predetermined opening degree, the outdoor expansion valve (14) is fully closed, the opening degree of the refrigeration-facility expansion valve (53) is adjusted through superheating control, and the opening degree of the first decompression valve (40) is appropriately adjusted. The indoor fan (62) and the interior fan (52) are operated, and the outdoor fan (12) is stopped. The first compressor (21) and the second compressor (22) are operated, and the third compressor (23) is stopped. During the heating and refrigeration-facility heat recovery operation, a refrigeration cycle is performed in which the refrigerant compressed in the compression unit (20) radiates heat in the indoor heat exchanger (64) and evaporates in the refrigeration-facility heat exchanger (54), and the outdoor heat exchanger (13) is substantially stopped.

As illustrated in FIG. 7, the refrigerant compressed in the second compressor (22) is sucked into the first compressor (21). The refrigerant compressed in the first compressor (21) radiates heat in the indoor heat exchanger (64). As a result, the indoor air is heated. The refrigerant having radiated heat in the indoor heat exchanger (64) flows through the gas-liquid separator (15), and is cooled in the first refrigerant flow path (16*a*) of the cooling heat exchanger (16). The refrigerant in the second refrigerant flow path (16*b*) that has cooled the refrigerant in the first refrigerant flow path (16*a*) flows through the injection passage (38) and is sucked into the first compressor (21). The refrigerant cooled in the first refrigerant flow path (16*a*) of the cooling heat exchanger (16) is decompressed by the refrigeration-facility expansion valve (53) and then evaporates in the refrigeration-facility heat exchanger (54). The refrigerant having evaporated in the refrigeration-facility heat exchanger (54) is sucked into the second compressor (22) to be compressed again.

<Heating and Refrigeration-Facility Residual Heat Operation>

Figure 8:
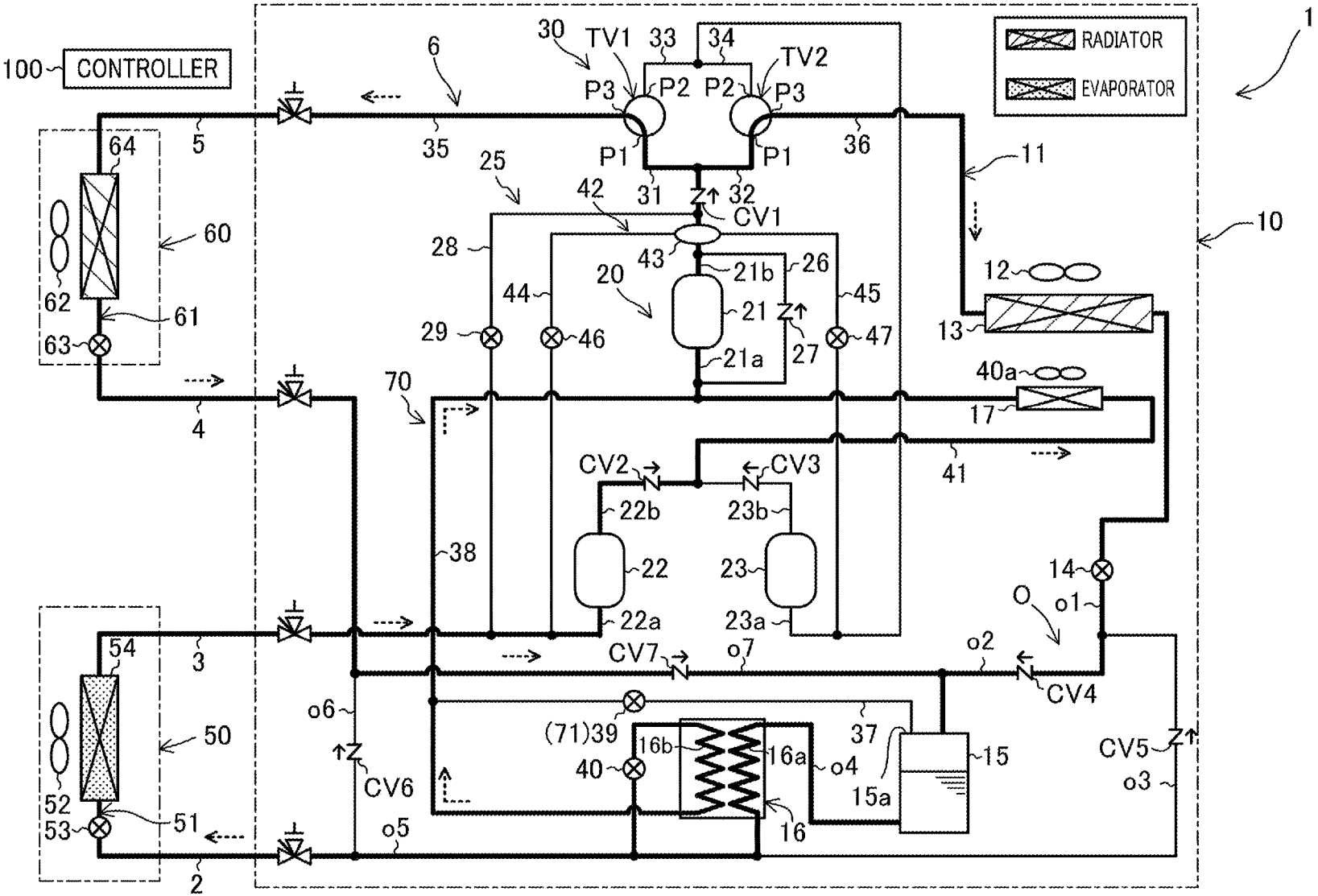
FIG. 8 is a diagram corresponding to FIG. 1, illustrating a flow of refrigerant in a heating and refrigeration-facility residual heat operation.

As illustrated in FIG. 8, during the heating and refrigeration-facility residual heat operation, the first three-way valve (TV1) is in the first communication state, and the second three-way valve (TV2) is in the second communication state. The indoor expansion valve (63) and the outdoor expansion valve (14) are opened at a predetermined opening degree, the opening degree of the refrigeration-facility expansion valve (53) is adjusted through superheating control, and the opening degree of the first decompression valve (40) is appropriately adjusted. The outdoor fan (12), the interior fan (52), and the indoor fan (62) are operated. The first compressor (21) and the second compressor (22) are operated, and the third compressor (23) is stopped. During the heating and refrigeration-facility residual heat operation, a refrigeration cycle is performed in which the refrigerant compressed in the compression unit (20) radiates heat in the indoor heat exchanger (64) and the outdoor heat exchanger (13) and evaporates in the refrigeration-facility heat exchanger (54).

As illustrated in FIG. 8, the refrigerant compressed in the second compressor (22) is sucked into the first compressor (21). Part of the refrigerant compressed in the first compressor (21) radiates heat in the outdoor heat exchanger (13). The rest of the refrigerant compressed in the first compressor (21) radiates heat in the indoor heat exchanger ((A). As a result, the indoor air is heated. The refrigerant having radiated heat in the outdoor heat exchanger (13) and the refrigerant having radiated heat in the indoor heat exchanger (64) merge with each other, then flow through the gas-liquid separator (15), and are cooled in the first refrigerant flow path (16*a*) of the cooling heat exchanger (16). The refrigerant in the second refrigerant flow path (16*b*) that has cooled the refrigerant in the first refrigerant flow path (16*a*) flows through the injection passage (38) and is sucked into the first compressor (21). The refrigerant cooled in the first refrigerant flow path (16*a*) of the cooling heat exchanger (16) is decompressed by the refrigeration-facility expansion valve (53) and then evaporates in the refrigeration-facility heat exchanger (54). As a result, the interior air is cooled. The refrigerant having evaporated in the refrigeration-facility heat exchanger (54) is sucked into the second compressor (22) to be compressed again.

<Defrost Operation>

The same operation as the cooling operation illustrated in FIG. 4 is performed in the defrost operation. In the defrost operation, the refrigerant compressed in the second compressor (22) and the first compressor (21) radiates heat in the outdoor heat exchanger (13). As a result, frost on the surface of the outdoor heat exchanger (13) is heated from inside. The refrigerant that has been used for defrosting the outdoor heat exchanger (13) evaporates in the indoor heat exchanger (64), and then is sucked into the second compressor (22) to be compressed again.

<Gas Vent Control of Gas-Liquid Separator while Compression Unit is Stopped>

Figure 9:
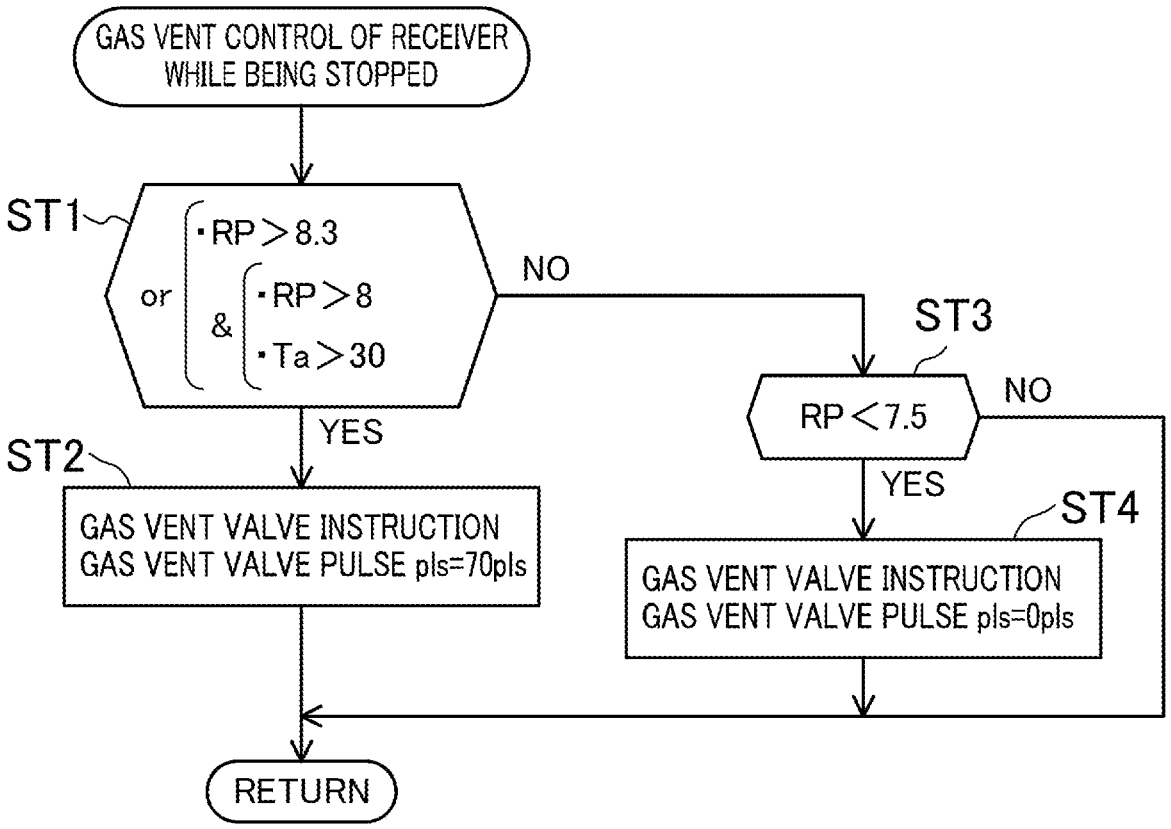
FIG. 9 is a flowchart showing gas vent control of a gas-liquid separator while a compressor is stopped.
Figure 10:
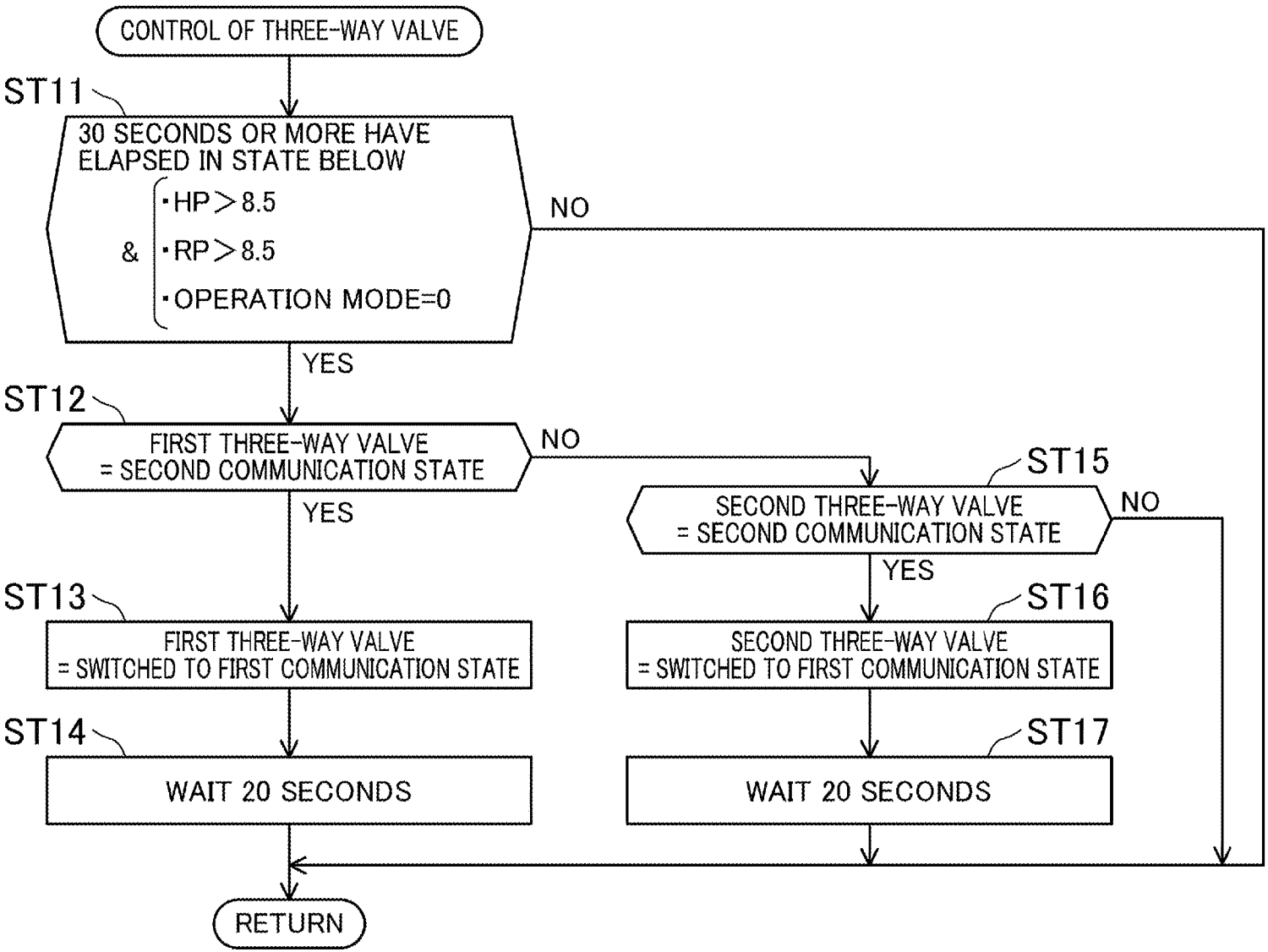
FIG. 10 is a flowchart showing control of a switching device (three-way valve).

In the present embodiment, gas vent control of the gas-liquid separator (15) is performed when outside air temperature is higher than a critical point temperature of the refrigerant in a state where the compressor is stopped. FIG. 9 is a flowchart illustrating an example of the gas vent control. FIG. 10 is a flowchart illustrating control of the switching unit (30) performed during the gas vent control.

In the flowchart in FIG. 9, in step ST1, it is determined whether any one of the following two conditions is satisfied. A first condition is that a pressure RP in the gas-liquid separator (15) is higher than 8.3 (MPa). A second condition is that the pressure RP in the gas-liquid separator (15) is higher than 8.0 (MPa) and an outside air temperature Ta is higher than 30 (° C.). When either of these conditions is satisfied, it is determined that the pressure inside the gas-liquid separator (15) is higher than the critical pressure.

When any of the conditions in step ST1 is satisfied, the processing proceeds to step ST2. In step ST2, an opening degree signal of, for example, 70 pulses is transmitted to a pulse motor of the gas vent valve (39) to adjust a valve opening degree, and the processing returns to step ST1. By adjusting the opening degree of the gas vent valve (39) as described above, the refrigerant in the gas-liquid separator (15) passes through the intermediate flow path (41) from the injection passage (38) as the first gas passage and flows into the intermediate heat exchanger (13) while the compression unit (20) is stopped. As a result, the pressure inside the gas-liquid separator (15) decreases.

When the pressure in the gas-liquid separator (15) is still higher than the critical pressure in this state, although not shown in the flowchart in FIG. 9, the bypass valve (29) of the second bypass passage (28) is controlled to be opened. When the refrigeration-facility heat exchanger (54) serves as the evaporator before the compression unit (20) is stopped, the refrigerant in the gas-liquid separator (15) also flows into the refrigeration-facility heat exchanger (54). Specifically, the refrigerant in the gas-liquid separator (15) flows into the refrigeration-facility heat exchanger (54) through the injection passage (38), the first suction pipe (21*a*), the first bypass passage (26), the second bypass passage (28), and the first gas connection pipe (3). As a result, the pressure inside the gas-liquid separator (15) further decreases.

When the conditions in step ST1 are not satisfied, the processing proceeds to step ST3. In step ST3, it is determined whether the pressure RP of the gas-liquid separator (15) is lower than 7.5 (MPa). When the condition in step ST3 is satisfied, it is determined that the pressure inside the gas-liquid separator (15) is lower than the critical pressure, and the processing proceeds to step ST4. In step ST4, an opening degree signal of 0 pulse is transmitted to the pulse motor of the gas vent valve (39), and the gas vent valve (39) is closed. In this state, the refrigerant in the gas-liquid separator (15) does not flow into any heat exchanger. After the control in step ST4, the processing returns to step ST1.

When the condition in step ST3 is not satisfied, the control of the gas vent valve (39) is not performed, the processing returns to step ST1, and the control in steps ST1 to ST4 is repeated.

When the indoor heat exchanger (64) serves as the evaporator or the outdoor heat exchanger (13) serves as the evaporator before the compression unit (20) is stopped, the control illustrated in the flowchart in FIG. 10 is performed after the control illustrated in the flowchart in FIG. 9 is performed.

In this flow, in step ST11, it is determined whether all three conditions are satisfied, that is, a high pressure HP of the refrigerant circuit is higher than 8.5 (MPa), the pressure RP in the gas-liquid separator (15) is higher than 8.5 (MPa), and an operating mode is a stop mode (operation mode shown in the drawing=0), and whether this state is continued for 30 seconds or more.

When the condition in step ST11 is satisfied, the processing proceeds to step ST12, and it is determined whether the first three-way valve (TV1) is in the second communication state. When the first three-way valve (TV1) is in the second communication state, the processing proceeds to step ST13, and the first three-way valve (TV1) is switched to the first communication state. In step ST14, the processing waits for 20 seconds to elapse in this state, and returns to step ST11.

When the first three-way valve (TV1) is not in the second communication state upon determination in step ST12, it is determined in step ST15 whether the second three-way valve (TV2) is in the second communication state. When the second three-way valve (TV2) is in the second communication state, the second three-way valve (TV2) is switched to the first communication state in step ST16, the processing waits for 20 seconds to elapse in this state in step ST17, and returns to step ST11. When the second three-way valve (TV2) is not in the second communication state upon determination in step ST15, neither the first three-way valve (TV1) nor the second three-way valve (TV2) is switched, and the processing returns to step ST11.

Under the control of steps ST13 and ST16, both the first three-way valve (TV1) and the second three-way valve (TV2) enter the first communication state, and the outdoor heat exchanger (13) and the indoor heat exchanger (64) communicate with each other. As a result, when either the outdoor heat exchanger (13) or the indoor heat exchanger (64) serves as the evaporator, the refrigerant in the radiator flows into the evaporator to equalize the pressure therebetween. At this time, since the gas vent valve (39) and the bypass valve (29) are opened as described above, the refrigerant in the gas-liquid separator (15) flows into the outdoor heat exchanger (13) and the indoor heat exchanger (64) including the heat exchanger serving as the evaporator before the compression unit (20) is stopped.

Effects of First Embodiment

In the present embodiment, provided are the gas passage (70) that communicates with the gas outlet (15*a*) of the gas-liquid separator (15) and at least one of a plurality of heat exchangers (13, 17, 54, 64), the opening and closing device (71) that opens and closes the gas passage (70), and the controller (100) that closes the opening and closing device (71) when the pressure in the gas-liquid separator (15) is equal to or less than a predetermined value in a state where the compression unit (20) is stopped, and opens the opening and closing device (71) when the pressure in the gas-liquid separator (15) is higher than the predetermined value.

Here, in the conventional refrigeration apparatus using carbon dioxide as a refrigerant, when the outside air temperature becomes equal to or higher than the critical point temperature (about 32° C.), the refrigerant is vaporized to increase the volume. Therefore, the pressure in the gas-liquid separator (15) increases. When the outside air temperature is high, a cooling load on a utilization side usually increases, but the cooling load may be small in some cases. In such a case, excessive refrigerant is likely to be generated, and in particular, the refrigerant in the gas-liquid separator (15) becomes excessive, and pressure abnormality inside the gas-liquid separator (15) may occur.

In order to suppress the occurrence of pressure abnormality inside the gas-liquid separator (15) when the outside air temperature is high, it is conceivable to increase the capacity of the gas-liquid separator (15) or to provide a dedicated container such as an expansion tank. However, in this case, the devices constituting the refrigeration apparatus increase in size or the number of devices increases.

In the present embodiment, the opening and closing device (71) of the gas passage (70) is opened when the pressure in the gas-liquid separator (15) is higher than a predetermined value in a state where the compression unit (20) is stopped. Thus, the refrigerant in the gas-liquid separator (15) can be released to at least one of the heat exchangers (13, 17, 54, 64). It is therefore possible to suppress the occurrence of pressure abnormality inside the gas-liquid separator (15) while the compression unit (20) is stopped without increasing the internal volume of the gas-liquid separator (15) or using a dedicated container such as an expansion tank. Accordingly, an increase in size and complexity of the apparatus can be suppressed. In addition, since the pressure inside the gas-liquid separator (15) can be reduced, the pressure resistance of the gas-liquid separator (15) does not need to be enhanced more than necessary. The pressure in the gas-liquid separator (15) can be detected by providing a pressure sensor in a pipe of a liquid-refrigerant outlet of the gas-liquid separator (15).

In the present embodiment, the compression unit (20) includes the low-stage side compression element (22, 23) and the high-stage side compression element (21) that further compresses the refrigerant compressed by the low-stage side compression element (22, 23). The plurality of heat exchangers (13, 17, 54, 64) include the intermediate heat exchanger (17) provided between the low-stage side compression element (22, 23) and the high-stage side compression element (21). The gas passage (70) includes the injection passage (first gas passage) (38) communicating with the gas-liquid separator (15) and the intermediate heat exchanger (17), and the opening and closing device (71) includes the gas vent valve (first opening and closing device) (39) provided in the first gas passage (38).

In the configuration, the gas vent valve (39) provided in the injection passage (38) is opened when the pressure in the gas-liquid separator (15) is higher than a predetermined value in a state where the compression unit (20) is stopped. Thus, the refrigerant in the gas-liquid separator (15) flows into the intermediate heat exchanger (17). It is therefore possible to suppress the occurrence of pressure abnormality inside the gas-liquid separator (15) without using an expansion tank or the like.

In the present embodiment, the plurality of heat exchangers (13, 17, 54, 64) include a radiator and an evaporator that constitute the refrigeration cycle of the refrigerant circuit (6), and the gas passage (70) includes the second gas passage (25) communicating with the heat exchanger having functioned as an evaporator before the compression unit (20) is stopped when the pressure in the gas-liquid separator (15) is higher than the predetermined value.

In this configuration, the opening and closing device (71) of the gas passage (70) is opened when the pressure in the gas-liquid separator (15) is higher than the predetermined value in a state where the compression unit (20) is stopped. Since the gas passage (70) includes the second gas passage (25), the refrigerant in the gas-liquid separator (15) flows into the heat exchanger having functioned as the evaporator before the compression unit (20) is stopped. It is therefore possible to suppress the occurrence of pressure abnormality inside the gas-liquid separator (15) without using a dedicated container such as an expansion tank.

In the present embodiment, the second gas passage (25) includes the first bypass passage (26) that bypasses the high-stage side compression element (21) and communicates with the suction side flow path (21*a*) and the discharge side flow path (21*b*) of the high-stage side compression element (21), and the second bypass passage (28) that communicates with the discharge side flow path (21*b*) of the high-stage side compression element (21) and the suction side flow path (22*a*) of the low-stage side compression element (22). The opening and closing device (71) includes the bypass valve (second opening and closing device) (29) provided in the second bypass passage (28).

In this configuration, in the configuration according to the present embodiment in which the compression unit (20) has the low-stage side compression element (22, 23) and the high-stage side compression element (21), when the pressure in the gas-liquid separator (15) is higher than the predetermined value in a state where the compression unit (20) is stopped, the gas vent valve (39) of the injection passage (38) and the bypass valve (29) of the second bypass passage (28) are opened. The first gas passage (38) communicates with the intermediate heat exchanger (17) and also communicates with the suction side flow path (21*a*) of the high-stage side compression element (21). Thus, the refrigerant in the gas-liquid separator (15) bypasses the first compressor (21) from the suction side flow path (21*a*), passes through the first bypass passage, further passes through the second bypass passage (28), and flows into the suction side flow path (22*a*) of the second compressor (22). Since the suction side flow path (22*a*) of the second compressor (22) communicates with the refrigeration-facility heat exchanger (54), the refrigerant flows into the refrigeration-facility heat exchanger (54) serving as the evaporator before the compression unit (20) is stopped. It is therefore possible to suppress the occurrence of pressure abnormality inside the gas-liquid separator (15) without using an expansion tank or the like.

In the present embodiment, when the pressure in the gas-liquid separator (15) is higher than the predetermined value in a state where the compression unit (20) is stopped, the controller (100) opens the first opening and closing device (39) to cause the gas refrigerant in the gas-liquid separator (15) to be introduced into the intermediate heat exchanger (17). When the pressure in the gas-liquid separator (15) is still higher than the predetermined value even in this state, the controller (100) opens the second opening and closing device (29). As a result, the refrigerant in the gas-liquid separator (15) flows into the intermediate heat exchanger (17), and then flows into the refrigeration-facility heat exchanger (54) serving as an evaporator before the compression unit (20) is stopped.

In this way, the refrigerant sequentially flows into the intermediate heat exchanger (17) and the refrigeration-facility heat exchanger (54) serving as the evaporator before the compression unit (20) is stopped, and thus the occurrence of pressure abnormality inside the gas-liquid separator (15) can be more effectively suppressed.

In the present embodiment, as described above, the refrigerant circuit (6) includes the outdoor heat exchanger (13), the refrigeration-facility heat exchanger (54), the indoor heat exchanger (64), and the switching unit (30) that switches the circulation direction of the refrigerant in the refrigerant circuit (6). The switching unit (30) can be set to the first state in which the indoor heat exchanger (64) communicates with the suction side flow path (21*a*) of the compression unit (20) and the outdoor heat exchanger (13) communicates with the discharge side flow path (21*b*) of the compression unit (20). The switching unit (30) can be set to the second state in which the indoor heat exchanger (64) communicates with the discharge side flow path (21*b*) of the compression unit (20) and the outdoor heat exchanger (13) communicates with the suction side flow path (21*a*) of the compression unit (20). The switching unit (30) can also be switched to the third state in which the indoor heat exchanger (64) and the outdoor heat exchanger (13) communicate with each other. In the third state, the gas passage (70) communicates with the indoor heat exchanger (64) and the outdoor heat exchanger (13).

In the present embodiment, the opening and closing device (71) of the gas passage (70) is opened when the pressure in the gas-liquid separator (15) is higher than the predetermined value in a state where the compression unit (20) is stopped. At this time, when the switching unit (30) is switched to the third state, the gas passage communicates with both the indoor heat exchanger (64) and the outdoor heat exchanger (13). Accordingly, the indoor heat exchanger (64) and the outdoor heat exchanger (13) are equalized in pressure. Thus, when one of the heat exchangers of the indoor heat exchanger (64) and the outdoor heat exchanger (13) serves as the evaporator before the compression unit is stopped, the refrigerant of the gas-liquid separator (15) flows into the heat exchanger serving as the evaporator and the other heat exchanger. It is therefore possible to suppress the occurrence of pressure abnormality inside the gas-liquid separator (15) while the compression unit (20) is stopped.

Modifications of First Embodiment

Instead of the second bypass passage (28) of the first embodiment, the first oil return pipe (44) connected to the oil separator (43) and the second suction pipe (22*a*) can be used as a second bypass passage communicating with the gas-liquid separator (15) and the refrigeration-facility heat exchanger (54). In such a configuration, when the refrigeration-facility heat exchanger (54) serves as the evaporator before the compression unit (20) is stopped, the first oil amount regulating valve (46) is opened instead of opening the second bypass valve (29) in the first embodiment. As a result, the refrigerant flows into the refrigeration-facility heat exchanger (54) through the first oil return pipe (44) functioning as the second bypass passage.

The second oil return pipe (45) connected to the oil separator (43) and the third suction pipe (23*a*) can be used as a second bypass passage communicating with the gas-liquid separator (15) and the outdoor heat exchanger (13). In such a configuration, when the outdoor heat exchanger (13) serves as the evaporator before the compression unit (20) is stopped, the second oil amount regulating valve (47) is opened instead of opening the second bypass valve (29) in the first embodiment. As a result, the refrigerant flows into the outdoor heat exchanger (13) through the second oil return pipe (45) functioning as the second bypass passage.

Second Embodiment

Figure 11:
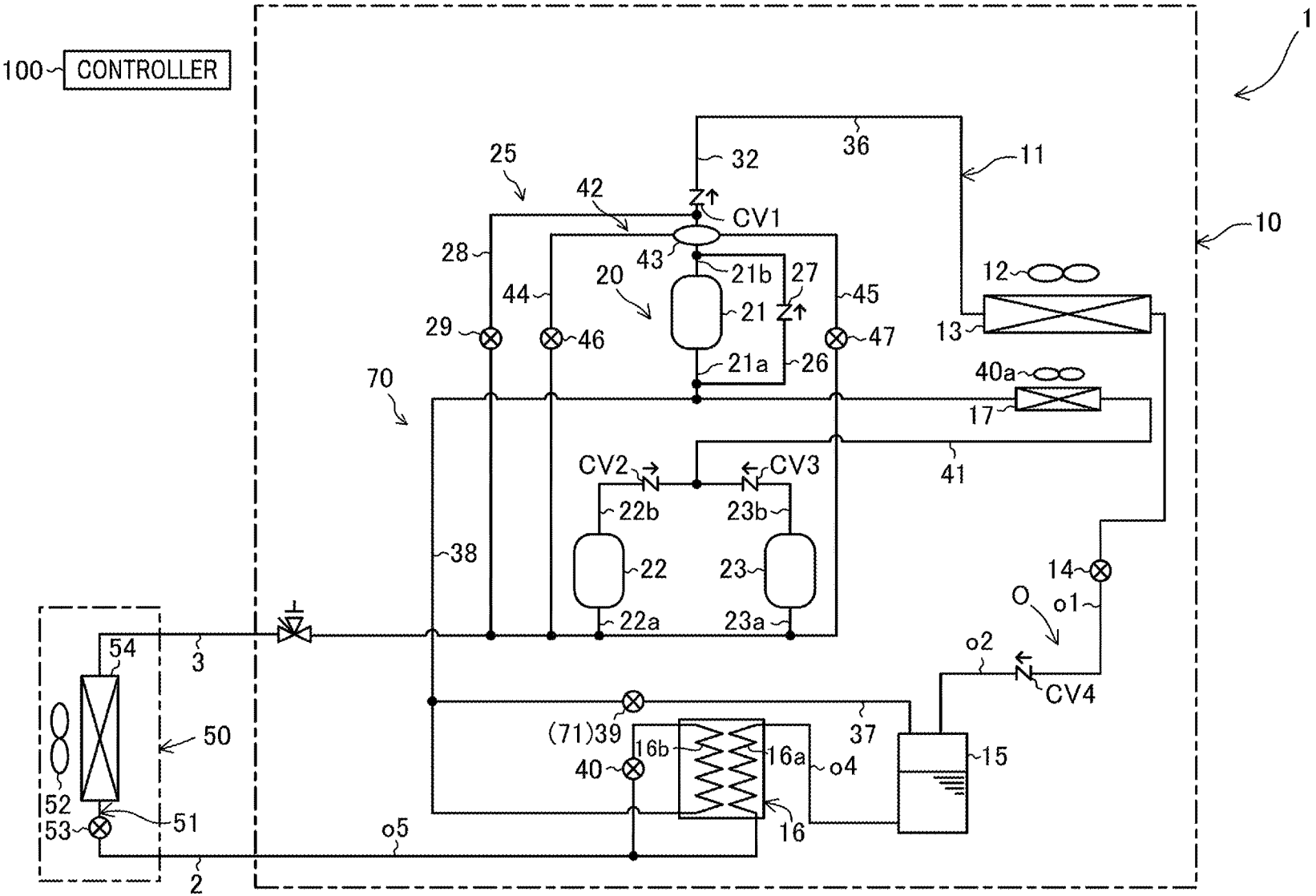
FIG. 11 is a piping system diagram of a refrigeration apparatus according to a second embodiment.

A second embodiment illustrated in FIG. 11 will be described.

The refrigeration apparatus (1) according to the second embodiment is identical to the refrigeration apparatus according to the first embodiment in that the refrigeration apparatus (1) includes the outdoor unit (10) and the refrigeration-facility unit (50). However, the refrigeration apparatus (1) according to the second embodiment does not include the indoor unit (60) configured to air-condition a room. In the refrigerant circuit (6), the refrigerant circulates only in a direction in which the refrigerant sequentially flows through the compression unit (20), the outdoor heat exchanger (13), the gas-liquid separator (15), the cooling heat exchanger (16), and the refrigeration-facility heat exchanger (54). Therefore, in the second embodiment, the switching unit (30) according to the first embodiment that reverses the circulation direction of the refrigerant is not provided. Other device configurations in the refrigerant circuit (6) of the refrigeration apparatus (1) are similar to those of the first embodiment.

In the present embodiment, a refrigeration cycle in which the outdoor heat exchanger (13) functions as the radiator and the refrigeration-facility heat exchanger (54) functions as the evaporator.

In the present embodiment, the opening and closing device (71) of the gas passage (70) is opened when the pressure in the gas-liquid separator (15) is higher than a predetermined value in a state where the compression unit (20) is stopped. Thus, the refrigerant in the gas-liquid separator (15) can be released to at least one of the heat exchangers (17, 54) (the intermediate heat exchanger (17) and the refrigeration-facility heat exchanger (54) serving as the evaporator before the compression unit (20) is stopped). It is therefore possible to suppress the occurrence of pressure abnormality inside the gas-liquid separator (15) while the compression unit (20) is stopped without increasing the internal volume of the gas-liquid separator (15) or using a dedicated container such as an expansion tank. Accordingly, an increase in size and complexity of the apparatus can be suppressed. In addition, since the pressure inside the gas-liquid separator (15) can be reduced, the pressure resistance of the gas-liquid separator (15) does not need to be enhanced more than necessary.

Other Embodiments

For example, the above embodiments may adopt the following configurations.

In the first embodiment, in the gas passage (70), the gas-liquid separator (15) and the intermediate heat exchanger (17) communicate with each other via the injection passage (first gas passage) (38), the gas-liquid separator (15) and the refrigeration-facility heat exchanger (54) communicate with each other via the injection passage (first gas passage) (38) and the second gas passage (25) (the first bypass passage (26) and the second bypass passage (28)), and the gas-liquid separator (15) and the outdoor heat exchanger (13) communicate with each other via the injection passage (first gas passage) (38) and the second gas passage (25)(the first bypass passage (26) and the second oil return pipe (second bypass passage) (45)). In the above embodiment, the gas-liquid separator (15) communicates with the outdoor heat exchanger (13) and the indoor heat exchanger (64) via the injection passage (first gas passage) (38) and the first bypass passage (26) in a state where the outdoor heat exchanger (13) and the indoor heat exchanger (64) communicate with each other via the switching unit (30). However, the gas-liquid separator (15) does not need to communicate with all of the plurality of heat exchangers (13, 17, 54, 64), but may need to communicate with at least one of the plurality of heat exchangers (13, 17, 54, 64).

In the above embodiment, the compression unit (20) includes the high-stage side compressor (21) and the low-stage side compressor (22, 23). However, the compression unit (20) may be configured such that the high-stage side compression element and the low-stage side compression element are accommodated in a casing of one compressor.

In the above embodiment, the compression unit (20) includes the low-stage side compression element (22, 23) and the high-stage side compression element (21) that further compresses the refrigerant compressed by the low-stage side compression element (22, 23), and in this configuration, the refrigerant in the gas-liquid separator (15) can be released to the intermediate heat exchanger (17). However, in the configuration in which the compression unit (20) includes the low-stage compression element (22, 23) and the high-stage side compression element (21), when the pressure in the gas-liquid separator (15) is higher than the predetermined value, the gas passage (70) may communicate with the heat exchanger having functioned as the evaporator before the compression unit (20) is stopped. In this case, the first bypass passage (26) and the second bypass passages (28, 44)(45) may be provided without providing the intermediate heat exchanger (17) in the refrigerant circuit (6) in FIG. 1. The gas passage (70) may be a passage communicating with the gas-liquid separator (15) and the suction pipe (22*a*, 23*a*) of the low-stage compression element (22, 23) without providing the first bypass passage (26) and the second bypass passage (28, 44) (45).

In such configuration, when the pressure in the gas-liquid separator (15) is higher than the predetermined value in a state where the compression unit (20) including the low-stage side compression element (22, 23) and the high-stage side compression element (21) is stopped, the refrigerant in the gas-liquid separator (15) passes through the gas passage (70) and flows into the heat exchanger having functioned as the evaporator before the compression unit (20) is stopped. It is therefore possible to suppress the occurrence of pressure abnormality inside the gas-liquid separator (15).

In the above embodiment, the switching unit (30) includes two three-way valves (TV1, TV2), but the switching unit (30) may be configured by using two four-way switching valves of an electric switching type instead of the three-way valves and by closing one port of each of the four-way switching valves. Instead of the three-way valves (TV1, TV2), the switching unit (30) may be configured by combining a plurality of electromagnetic valves.

In the above embodiment, an example in which carbon dioxide is used as the refrigerant has been described, but the refrigerant is not limited to carbon dioxide. In the heat source unit and the refrigeration apparatus of the present disclosure, the refrigerant may be any refrigerant as long as the high pressure of the refrigerant circuit is equal to or higher than the critical pressure.

The embodiments and the modifications have been described above, but it will be understood that various changes can be made to modes and details without departing from the spirit and the scope of the claims. The above embodiments and the modifications may be combined or replaced as appropriate as long as target functions of the present disclosure are not impaired.

INDUSTRIAL APPLICABILITY

As described above, the present disclosure is useful for a heat source unit and a refrigeration apparatus.

REFERENCE SIGNS LIST

1: refrigeration apparatus
6: refrigerant circuit
10: outdoor unit (heat source unit)
13: outdoor heat exchanger (heat source heat exchanger)
15: gas-liquid separator
15*a*: gas outlet
17: intermediate cooler (intermediate heat exchanger)
21: first compressor (high-stage side compression element)
21*a*: first suction pipe (suction side flow path)
21*b*: first discharge pipe (discharge side flow path)
22: second compressor (low-stage side compression element)
22*a*: second suction pipe (suction side flow path)
23: third compressor (low-stage side compression element)
23*a*: third suction pipe (suction side flow path)
25: second gas passage
26: first bypass passage
28: second bypass passage
29: bypass valve (second opening and closing device)
30: switching unit (switching device)
38: injection passage (first gas passage)
39: gas vent valve (first opening and closing device)
44: first oil return pipe (second bypass passage)
45: second oil return pipe (second bypass passage)
46: first oil amount regulating valve (second opening and closing device)
47: second oil amount regulating valve (second opening and closing device)
50: refrigeration-facility unit (utilization unit)
54: refrigeration-facility heat exchanger (heat exchanger for a refrigeration facility (utilization heat exchanger))
60: indoor unit (utilization unit)
64: indoor heat exchanger (air conditioning heat exchanger (utilization heat exchanger))
70: gas passage
71: opening and closing device
100: controller
C: compression unit

The invention claimed is:

1. A heat source unit constituting a refrigerant circuit connected to a utilization side apparatus and configured to perform a refrigeration cycle in which a high pressure is equal to or higher than a critical pressure of a refrigerant, the heat source unit comprising:

a compression unit;

a gas-liquid separator;

a gas passage configured to communicate with a gas outlet of the gas-liquid separator and a first heat exchanger provided in the refrigerant circuit;

an opening and closing device configured to open and close the gas passage; and an electronic controller configured to close the opening and closing device based on a pressure in the gas-liquid separator being equal to or less than a predetermined value and the compression unit being stopped, and open the opening and closing device based on the pressure in the gas-liquid separator being higher than the predetermined value and the compression unit being stopped.

2. The heat source unit according to claim 1, wherein the compression unit includes a low-stage side compression element and a high-stage side compression element configured to further compress the refrigerant compressed by the low-stage side compression element, the first heat exchanger is an intermediate heat exchanger provided between the low-stage side compression element and the high-stage side compression element, the gas passage includes a first gas passage communicating with the gas-liquid separator and the intermediate heat exchanger, and the opening and closing device includes a first opening and closing device provided in the first gas passage.

3. The heat source unit according to claim 1, wherein the refrigerant circuit includes the first heat exchanger and a second heat exchanger that perform the refrigeration cycle of the refrigerant circuit, the gas passage includes a second gas passage communicating with the second heat exchanger, and the electronic controller is configured to control the refrigerant circuit such that the second heat exchanger is configured to function as an evaporator when the compression unit is not stopped and the pressure in the gas-liquid separator is higher than the predetermined value.

4. The heat source unit according to claim 1, wherein the compression unit includes a low-stage side compression element and a high-stage side compression element configured to further compress the refrigerant compressed by the low-stage side compression element.

5. The heat source unit according to claim 2, wherein the refrigerant circuit includes the first heat exchanger and a second heat exchanger that perform the refrigeration cycle of the refrigerant circuit, the gas passage includes a second gas passage connected with the second heat exchanger, and the second heat exchanger is configured to function as the evaporator when the compression unit is not stopped and the pressure in the gas-liquid separator is higher than the predetermined value.

6. The heat source unit according to claim 5, wherein the second gas passage includes a first bypass passage configured to bypass the high-stage side compression element and communicate with a suction side flow path and a discharge side flow path of the high-stage side compression element, and a second bypass passage configured to communicate with the discharge side flow path of the high-stage side compression element and a suction side flow path of the low-stage side compression element, and the opening and closing device includes a second opening and closing device provided in the second bypass passage.

7. The heat source unit according to claim 6, wherein based on the pressure in the gas-liquid separator being higher than the predetermined value in a state where the compression unit is stopped, the electronic controller opens the first opening and closing device to cause a gas refrigerant in the gas-liquid separator to be introduced into the second heat exchanger, and when the pressure in the gas-liquid separator is higher than the predetermined value in the state, the electronic controller opens the second opening and closing device to cause the gas refrigerant in the gas-liquid separator to be introduced into the second heat exchanger, the electronic controller is configured to control the refrigerant circuit such that the second heat exchanger functions as an evaporator when the compression unit is not stopped.

8. The heat source unit according to claim 4, wherein the gas passage includes a first gas passage connected between the gas-liquid separator and the suction pipe of the high-stage side compression element, and the opening and closing device includes a first opening and closing device provided in the first gas passage.

9. The heat source unit according to claim 8, wherein the refrigerant circuit includes the first heat exchanger and a second heat exchanger that perform the refrigeration cycle of the refrigerant circuit a plurality of heat exchangers including the first heat exchanger and the second heat exchanger include a radiator and an evaporator that constitute the refrigeration cycle of the refrigerant circuit, the gas passage includes a second gas passage connected with the second heat exchanger, and the second heat exchanger is configured to function as the evaporator when the compression unit is not stopped and the pressure in the gas-liquid separator is higher than the predetermined value.

10. The heat source unit according to claim 9, wherein the second gas passage includes a first bypass passage configured to bypass the high-stage side compression element and communicate with a suction side flow path and a discharge side flow path of the high-stage side compression element, and a second bypass passage configured to communicate with the discharge side flow path of the high-stage side compression element and a suction side flow path of the low-stage side compression element, and the opening and closing device includes a second opening and closing device provided in the second bypass passage.

11. The heat source unit according to claim 1, wherein the refrigerant circuit includes a heat source heat exchanger, a utilization heat exchanger, and a switching device configured to switch a circulation direction of the refrigerant in the refrigerant circuit, the utilization heat exchanger includes an air conditioning heat exchanger and a refrigeration heat exchanger for a refrigeration facility, the electronic controller is configured to control the switching device to be in a first state in which the air conditioning heat exchanger communicates with the suction side flow path of the compression unit and the heat source heat exchanger communicates with the discharge side flow path of the compression unit, in a second state in which the air conditioning heat exchanger communicates with the discharge side flow path of the compression unit and the heat source heat exchanger communicates with the suction side flow path of the compression unit, and in a third state in which the air conditioning heat exchanger and the heat source heat exchanger communicate with each other, and the gas passage communicates with the air conditioning heat exchanger and the heat source heat exchanger in the third state.

12. The heat source unit according to claim 1, wherein the refrigerant in the refrigerant circuit is carbon dioxide.

13. A refrigeration apparatus comprising:

the heat source unit according to claim 1; and a utilization unit as the utilization side apparatus, wherein the refrigeration apparatus performs the refrigeration cycle in which a high pressure is equal to or higher than a critical pressure of a refrigerant.

14. A heat source unit constituting a refrigerant circuit connected to a utilization side apparatus and configured to perform a refrigeration cycle in which a high pressure is equal to or higher than a critical pressure of a refrigerant, the heat source unit comprising:

a compression unit;

a gas-liquid separator;

a gas passage configured to communicate with a gas outlet of the gas-liquid separator and a first heat exchanger provided in the refrigerant circuit;

an opening and closing device configured to open and close the gas passage; and a controller configured to close the opening and closing device based on a pressure in the gas-liquid separator being equal to or less than the critical pressure of high-pressure refrigerant in the refrigerant circuit and the compression unit being stopped, and open the opening and closing device based on the pressure in the gas-liquid separator being higher than the critical pressure and the compression unit being stopped.

15. A heat source unit constituting a refrigerant circuit connected to a utilization side apparatus and configured to perform a refrigeration cycle in which a high pressure is equal to or higher than a critical pressure of a refrigerant, the heat source unit comprising:

a compression unit;

a gas-liquid separator;

a gas passage configured to communicate with a gas outlet of the gas-liquid separator and a first heat exchanger provided in the refrigerant circuit;

an opening and closing device configured to open and close the gas passage; and a controller configured to close the opening and closing device based on a pressure in the gas-liquid separator being equal to or less than a predetermined value and the compression unit being stopped, and open the opening and closing device based on the pressure in the gas-liquid separator being higher than the predetermined value, an outside air temperature being higher than another predetermined value, and the compression unit being stopped.

* * * * *